US012584382B1

(12) United States Patent
Wood et al.

(10) Patent No.: US 12,584,382 B1
(45) Date of Patent: Mar. 24, 2026

(54) SYSTEMS AND METHODS FOR PIPE CONVEYED GRAVEL PACK

(71) Applicant: Chevron U.S.A. Inc., San Ramon, CA (US)

(72) Inventors: William Dale Wood, Montgomery, TX (US); John Barton Weirich, Spring, TX (US); Patrick James Zimmerman, Sr., Houston, TX (US); Harold Gordon Riordan, Houston, TX (US); Alvaro Jose Arrazola, Houston, TX (US); Harry Anderson Hope, Humble, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 19/256,324

(22) Filed: Jul. 1, 2025

(51) Int. Cl.
*E21B 43/04* (2006.01)

(52) U.S. Cl.
CPC ..... *E21B 43/04* (2013.01)

(58) Field of Classification Search
CPC ..... E21B 27/00; E21B 27/02; E21B 43/04
See application file for complete search history.

(56) References Cited

U.S. PATENT DOCUMENTS 2,776,011 A * 1/1957 Clark ..... E21B 43/04 166/51

* cited by examiner

*Primary Examiner* — Tara Schimpf
*Assistant Examiner* — Lamia Quaim
(74) *Attorney, Agent, or Firm* — Smith & Woldesenbet Law Group, PLLC

(57) ABSTRACT

A gravel pack production string component of a production string used for a gravel pack operation may include a body having a wall that forms a cavity, and also may include a gravel load disposed around an outer surface of the wall of the body. The gravel pack production string component may also include a gravel containment apparatus that is configured to secure the gravel load against the outer surface of the wall of the body as the gravel pack production string component is inserted into a wellbore. The gravel pack production string component may further include a release mechanism that is configured to release the gravel load from the gravel containment apparatus after the gravel pack production string component is positioned within the wellbore for the gravel pack operation and when the release mechanism interacts with a release agent.

20 Claims, 18 Drawing Sheets

SYSTEMS AND METHODS FOR PIPE CONVEYED GRAVEL PACK

TECHNICAL FIELD

The present disclosure relates to a production of subterranean resources, and more specifically to pipe conveyed gravel pack.

BACKGROUND

In a number of wells (e.g., for oil, for gas, for water), a solution to formation sand production is to place a gravel pack in the wellbore adjacent to and between the borehole wall and a screen. The first part of this procedure is to run a tubing string (e.g., a work string, a production string) into the wellbore, where the distal end of the tubing string has one or more screens that act as a barrier against sand movement. Subsequently, as a separate operation in this procedure, a slurry of gravel is pumped into the annulus. Finally, the gravel is packed within the annulus adjacent to the sand in the formation so that the gravel acts as a filter that allows fluids to flow therethrough while blocking the sand during production.

SUMMARY

In general, in one aspect, the disclosure relates to a gravel pack production string component of a production string used for a gravel pack operation. The gravel pack production string component may include a body having a wall that forms a cavity. The gravel pack production string component may also include a gravel load disposed around an outer surface of the wall of the body. The gravel pack production string component may further include a gravel containment apparatus that is configured to secure the gravel load against the outer surface of the wall of the body as the gravel pack production string component is inserted into a wellbore. The gravel pack production string component may also include a release mechanism that is configured to release the gravel load from the gravel containment apparatus after the gravel pack production string component is positioned within the wellbore for the gravel pack operation and when the release mechanism interacts with a release agent.

In another aspect, the disclosure relates to a system for implementing a gravel pack operation. The system may include a wellbore control system that is configured to control a release agent within a wellbore. The system may also include a production string disposed in the wellbore, where the production string includes a gravel pack production string component. The gravel pack production string component of the production string may include a body having a wall that forms a cavity. The gravel pack production string component of the production string may also include a gravel load disposed around an outer surface of the wall of the body. The gravel pack production string component of the production string may further include a gravel containment apparatus that is configured to secure the gravel load against the outer surface of the wall of the body as the gravel pack production string component is inserted into a wellbore. The gravel pack production string component of the production string may also include a release mechanism that is configured to release the gravel load from the gravel containment apparatus after the gravel pack production string component is positioned within the wellbore for the gravel pack operation and when the release mechanism interacts with the release agent.

In yet another aspect, the disclosure relates to a method for implementing a gravel pack operation. The method may include directing a production string to be inserted into a wellbore, where the production string includes a gravel pack production string component, and where the gravel pack production string component includes a body comprising a wall that forms a cavity; a gravel load disposed around an outer surface of the wall of the body; a gravel containment apparatus that is configured to secure the gravel load against the outer surface of the wall of the body as the gravel pack production string component is inserted into a wellbore; and a release mechanism that is configured to release the gravel load from the gravel containment apparatus after the gravel pack production string component is positioned within the wellbore for the gravel pack operation and when the release mechanism interacts with a release agent. The method may also include directing a first stage of the gravel pack operation to be implemented, where the first stage includes exposing the release agent to the release mechanism of the gravel pack production string component.

These and other aspects, objects, features, and embodiments will be apparent from the following description and the appended claims.

BRIEF DESCRIPTION OF THE DRAWINGS

The drawings illustrate only example embodiments and are therefore not to be considered limiting in scope, as the example embodiments may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

DETAILED DESCRIPTION

The example embodiments discussed herein are directed to systems, apparatus, methods, and devices for gravel pack production string components. Example gravel pack production string components may be designed to comply with certain standards and/or requirements. Example gravel pack production string components may be designed for use in subterranean environments (e.g., high temperature, high pressure). Example embodiments may be used with wellbores that are subsea or land based. Due to the use of gravity with example gravel pack production string components, including a second stage fluidization of the gravel load, example embodiments may be used in a substantially vertical (e.g., within 30° of true vertical) section of a wellbore, in a transitional or intermediately sloped (within 43° of true vertical) section of a wellbore, and/or in a near horizontal (within 75° of true vertical) section of a wellbore. Example embodiments allow for a single trip, open-hole gravel pack (OHGP) completion.

Figure 1:
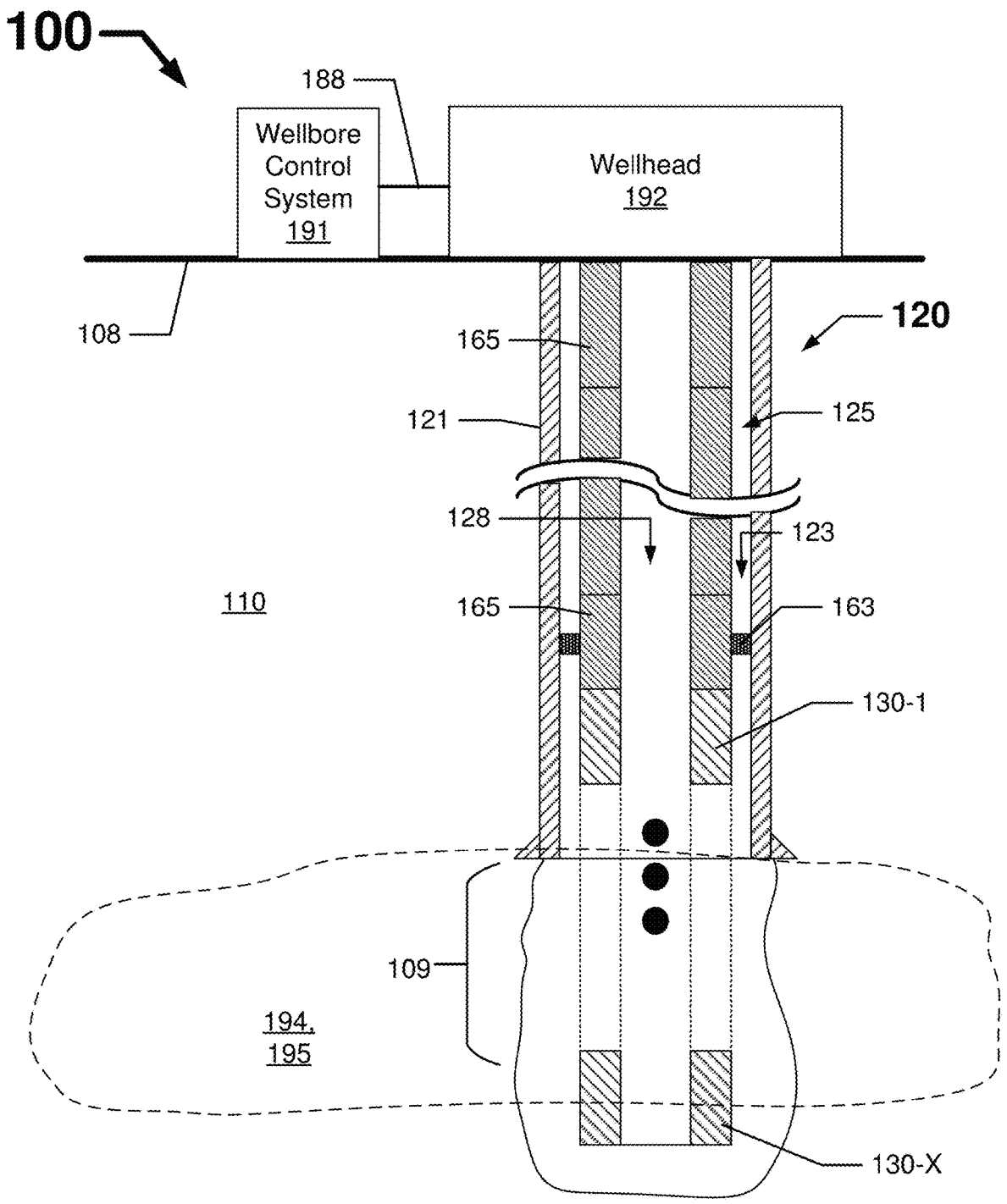
FIG. 1 shows a field system with which example embodiments may be used.

FIG. 1 shows a field system 100 with which example embodiments can be used. The field system 100 of FIG. 1 includes a wellbore 120, a wellbore control system 191, and a wellhead 192. The wellbore 120 is drilled into a subterranean formation 110 having multiple formation layers (e.g., shale, sandstone, limestone, dolomite, granite). In this case, the wellbore 120 is shown to be substantially vertical, but it is well known by those of ordinary skill in the art that the wellbore 120 may have some other orientation (e.g., slightly angled) that is not substantially vertical.

After the wellbore 120 (or segment thereof) is drilled, a casing string 121 (e.g., a series of casing pipes coupled to each other end to end) is inserted into the wellbore 120. In this case, the distal end of the casing string 121 terminates above a production zone 109, which means that the portion of the wellbore 120 below the casing string 121 is open hole in this example. In some cases, cement is injected into the space between the subterranean formation 110 and the outer surface of the casing string 121 to help stabilize and isolate the subterranean formation 110 around the wellbore 120. In order to make the production zone 109 adjacent to an open hole section of the wellbore 120, after the cement sets, a drilling string is run back into the hole to drill out the bottom of the cement/casing into the open hole section. In some cases, the drill bit of the drilling string may contain an under-reamer that allows the diameter of the open hole section (below the casing string 121) of the wellbore 120 to be larger than the ID of the casing string 121. The additional drilling step after cementing prevents or reduces contaminating the formation with used drilling muds and other issues. Once this completion process is complete, subsequent field operations (e.g., gravel packing, perforating, fracturing, producing) may occur.

In cases where the production zone 109 within the subterranean formation 110 includes formation material 194 (e.g., sand), a gravel pack operation may be performed to prevent most or all of the formation material 194 from being produced, thereby avoiding harmful effects of the formation material 194, including but not limited to blockages of flowlines, protection of screens from erosive flow (e.g., prevention of screens being cut out), instability of the wellbore 120, reduced productivity of the wellbore 120, and damage (e.g., corrosion, erosion) to some or all of the equipment (e.g., the wellhead 192, piping, valves) used for production of the wellbore 120.

For a gravel pack operation using example embodiments, a production string 125 (also sometimes called a tubing string 125 herein) is lowered into the wellbore 120 within the casing string 121. The production string 125 is made up of a number of components that are coupled (e.g., using coupling features such as mating threads) to each other end to end. Examples of such components may include, but are not limited to, one or more tubing pipes 165 and one or more example gravel pack production string components 130.

The production string 125 can have any of a number (e.g., 1, 2, 5, 10, 20, 30, 50) of example gravel pack production string components 130. For example, in this case, there are X example gravel pack production string components 130 (gravel pack production string component 130-1 through gravel pack production string component 130-X) in the production string 125. One or more of the example gravel pack production string components 130 may be positioned in the open hole portion of the wellbore 120 (e.g., below the casing string 121 and adjacent to the production zone 109). In certain example embodiments, the open hole portion of the wellbore extends beyond (e.g., above, below, above and below) the production zone 109 within the wellbore 120. In addition, or in the alternative, one or more of the example gravel pack production string components 130 of the production string 125 may be positioned within the casing string 121.

As a result, each of the example gravel pack production string components 130 of the production string 125 is positioned within (e.g., adjacent to) the production zone 109 and/or above (e.g., uphole of) the production zone 109. When there are multiple example gravel pack production string components 130 of the production string 125, adjacent example gravel pack production string components 130 may be directly coupled to each other. Alternatively, one or more of the adjacent example gravel pack production string components 130 of the production string 125 may have one or more of a number of other production string components (e.g., a tubing pipe 165, a collar, a valve, a return sleeve) positioned within the production string 125 between them.

The production string 125, including the example gravel pack production string components 130, forms a cavity 128 along its length. Also, the outer diameter of the production string 125 is less than the inner diameter of the casing string 121, and an annulus 123 results between the production string 125 and the casing string 121 when the production string 125 is inserted into the wellbore 120. In this case, the annulus 123 within the wellbore 120 above the production zone 109 is isolated by a gravel pack packer 163, which is positioned between a tubing pipe 165 in the production string 125 and the casing string 121 above the highest example gravel pack production string component 130 in the production string 125. The gravel pack packer 163 is configured to prevent all or substantially all fluidic communication therethrough.

When the production string 125 includes multiple example gravel pack production string components 130, the configuration of one gravel pack production string component 130 may be the same as (e.g., in terms of material, in terms of length, in terms of the screen mesh sizing (if any), in terms of how the gravel load is secured, in terms of how the gravel load is released), or different than, the configuration of one or more of the other gravel pack production string components 130. For example, the example gravel pack production string components 130 of the production string 125 that are positioned below the casing string 121 and adjacent to the production zone 109 may be configured in such a way that the inner wall is a screen that allows fluids to flow therethrough. As another example, the gravel pack production string components 130 of the production string 125 that are located adjacent to the casing string 121 may be configured in such a way that the inner wall is solid and non-permeable so that no fluids may flow therethrough while still flowing up the cavity 128.

Before the production of formation fluids 195 (e.g., a mixture of subterranean resources (e.g., oil, gas) and formation water) through the production zone 109 into the wellbore 120 may begin, a gravel pack operation is executed using the example gravel pack production string components 130. While more details are provided about example gravel pack production string components 130 below with respect to FIGS. 3A and 3B, each gravel pack production string component 130 carries a gravel load that is released after the production string 125 is inserted to depth within the wellbore 120, as shown in FIG. 1.

The wellhead 192 provides the structural and pressure-controlling interface between production equipment and the wellbore 120. The wellhead 192 may include any combination of valves, piping, hangers, sensor devices, spools, manifolds, seals, ports, and/or other components known in the art. The wellbore control system 191 is configured to control and/or implement one or both stages of a gravel pack operation according to certain example embodiments. For example, the wellbore control system 191 may implement one stage (e.g., the first stage) of a gravel pack operation by introducing a release agent (discussed below) within the wellbore 120. In addition, or in the alternative, the wellbore control system 191 may implement another stage (e.g., the second stage) of a gravel pack operation by imposing conditions with the wellbore 120 that reduces voids in the gravel load within the wellbore 120 after the gravel load is released from the gravel containment apparatus (discussed below) of an example gravel pack production string component 130.

The wellbore control system 191 may control one or more parameters (e.g., pressure, temperature, flow rate) within the wellbore 120 through piping 188 and the wellhead 192. The wellbore control system 191 may include any combination of valves, piping, pumps, sensor devices, compressors, regulators, and/or other components known in the art. In some cases, the wellbore control system 191 may include one or more systems (e.g., a wireline system, a coiled tubing system) that can be deployed down the cavity 128 of the production string 125. The wellbore control system 191 may be part of a drilling rig and/or equipment of a third party vendor. The wellhead 192 and the wellbore control system 191 are positioned at or proximate to the surface 108, which is the ground for land-based projects and the seabed for subsea projects. For subsea projects, some of the wellbore control system 191 may also be on a platform at or above the water level. For example, for some subsea projects, the surface 108 may be at or slightly above sea level (e.g., on the platform of a drilling rig, on the platform of a floating vessel)

Figure 2:
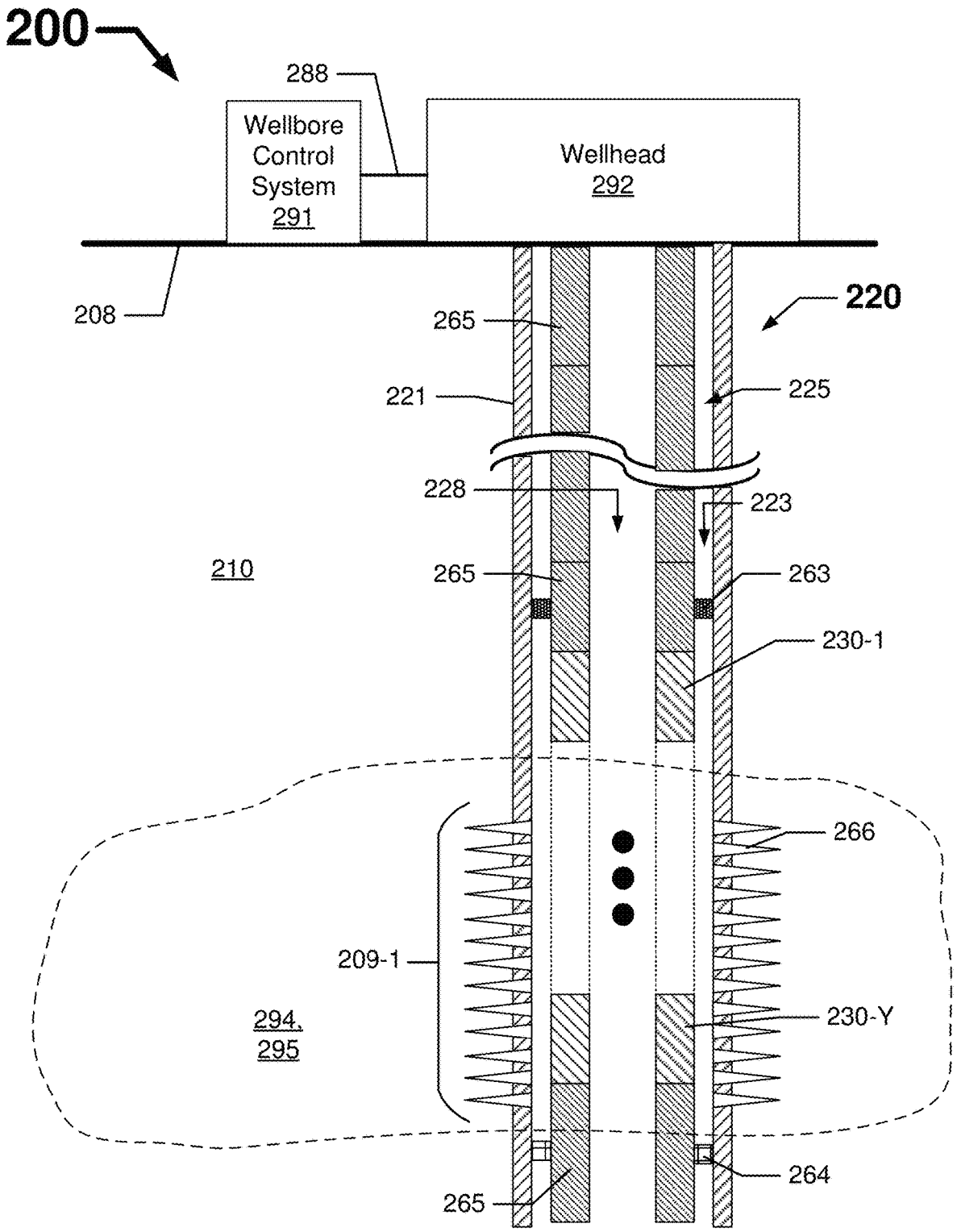
FIG. 2 shows another field system with which example embodiments may be used.

FIG. 2 shows another field system 200 with which example embodiments can be used. Referring to the description above with respect to FIG. 1, the field system 200 of FIG. 2 includes a wellbore 220, a wellbore control system 291, and a wellhead 292. The wellbore 220 is drilled into a subterranean formation 210 having multiple formation layers (e.g., shale, sandstone, limestone, dolomite, granite). In this case, the wellbore 220 is shown to be substantially vertical.

After the wellbore 220 (or segment thereof) is drilled, a casing string 221 (e.g., a series of casing pipes coupled to each other end to end) is inserted into the wellbore 220. In this case, the distal end of the casing string 221 extends through a production zone 209, which means that the portion of the wellbore 220 adjacent to and above the production zone 209 is cased. In some cases, cement is injected into the space between the subterranean formation 210 and the outer surface of the casing string 221 to help stabilize and isolate the subterranean formation 210 around the wellbore 220.

Once this completion process is complete, subsequent field operations (e.g., gravel packing, perforating, fracturing, producing) may occur. For example, an operation may be performed to generate multiple perforations 266 (e.g., made by a perforating sub of the production string 225) through the casing string 221, any cement that may have been injected into the space between the casing string 221 and the subterranean formation 210, and into the subterranean formation 210. The perforations 266 make the production fluids 295 (e.g., a mixture of subterranean resources (e.g., oil, gas) and formation water) within the subterranean formation 210 accessible for production through the wellbore 220. In cases where the production zone 209 within the subterranean formation 210 includes formation material 294 (e.g., sand), a gravel pack operation may be performed to prevent most or all of the formation material 294 from being produced, thereby avoiding harmful effects of the formation material 294, including but not limited to blockages of flowlines, protection of screens from erosive flow (e.g., prevention of screens being cut out), reduced productivity of the wellbore 220, and damage (e.g., corrosion, erosion, scaling) to some or all of the equipment (e.g., the wellhead 292, piping, valves) used for production of the wellbore 220.

For a gravel pack operation using example embodiments, a production string 225 (also sometimes called a tubing string 225 herein) is lowered into the wellbore 220 within the casing string 221. The production string 225 is made up of a number of components that are coupled (e.g., using coupling features such as mating threads) to each other end to end. Examples of such components may include, but are not limited to, one or more tubing pipes 265 and one or more example gravel pack production string components 230.

The production string 225 can have any of a number (e.g., 1, 2, 5, 10, 20, 30, 50) of example gravel pack production string components 230. For example, in this case, there are Y example gravel pack production string components 230 (gravel pack production string component 230-1 through gravel pack production string component 230-Y) in the production string 225. One or more of the example gravel pack production string components 230 may be positioned adjacent to the production zone 209. In addition, or in the alternative, one or more of the example gravel pack production string components 230 of the production string 225 may be positioned above the production zone 209.

As a result, each of the example gravel pack production string components 230 of the production string 225 is positioned within (e.g., adjacent to) the production zone 209 and/or above (e.g., uphole of) the production zone 209. When there are multiple example gravel pack production string components 230 of the production string 225, adjacent example gravel pack production string components 230 may be directly coupled to each other. Alternatively, one or more of the adjacent example gravel pack production string components 230 of the production string 225 may have one or more of a number of other production string components (e.g., a tubing pipe 265, a collar, a valve, a return sleeve) positioned within the production string 225 between them.

When the production string 225 includes multiple example gravel pack production string components 230, the configuration of one gravel pack production string component 230 may be the same as (e.g., in terms of material, in terms of length, in terms of the screen mesh sizing (if any), in terms of how the gravel load is secured, in terms of how the gravel load is released), or different than, the configuration of one or more of the other gravel pack production string components 230. For instance, the example gravel pack production string components 230 of the production string 225 that are positioned adjacent to the production zone 209 may be configured in such a way that the inner wall is a screen that allows fluids to flow therethrough. As another example, the gravel pack production string components 230 of the production string 225 that are located above the production zone 209 may be configured in such a way that the inner wall is solid and non-permeable so that no fluids may flow therethrough while still flowing up the cavity 228.

The production string 225 forms a cavity 228 along its length. Also, the outer diameter of the production string 225 is less than the inner diameter of the casing string 221, and an annulus 223 results between the production string 225 and the casing string 221 when the production string 225 is inserted into the wellbore 220. In this case, the portion of the tubing string 225 that is positioned within the wellbore 220 adjacent to the production zone 209 within the subterranean formation 210 is isolated through the annulus 223. Specifically, the annulus 223 within the wellbore 220 above the production zone 209 is isolated by a gravel pack packer 263, which is positioned between a tubing pipe 265 in the production string 225 and the casing string 221 above the highest example gravel pack production string component 230 in the production string 225. The gravel pack packer 263 is configured to prevent all or substantially all fluidic communication therethrough.

In addition, the annulus 223 within the wellbore 220 below the production zone 209 is isolated by a sump packer 264, which is positioned between a tubing pipe 265 in the production string 225 and the casing string 221 below the lowest example gravel pack production string component 230 in the production string 225. The sump packer 264 is configured to prevent all or substantially all fluidic communication therethrough. In addition, or in the alternative, the sump packer 264 is configured to support the weight of some or all of the gravel load that remains in the annulus 223 from a gravel pack operation.

While the system 200 of FIG. 2 shows a single production zone 209 in the subterranean formation 210 adjacent to the wellbore 220, in some cases there may be multiple production zones 209 along the wellbore 220. In such cases, one or more additional packers (e.g., isolation packers) may be set at various locations in the annulus 223 to allow for multiple gravel pack operations to occur simultaneously or in a sequence (e.g., using different release agents) within the wellbore 220. In addition, in such cases, the production string 225 may include one or more example gravel pack production string components 230 that are separated from one or more other gravel pack production string components 230 by other components (e.g., tubing pipes 265) in such a manner that allows for a successful utilization of the gravel pack operation within each production zone 209.

The wellhead 292 provides the structural and pressure-controlling interface between production equipment and the wellbore 220. The wellhead 292 may include any combination of valves, piping, hangers, sensor devices, spools, manifolds, seals, ports, and/or other components known in the art. The wellbore control system 291 is configured to control and/or implement one or both stages of a gravel pack operation according to certain example embodiments. For example, the wellbore control system 291 may implement the first stage of a gravel pack operation by introducing a release agent (discussed below) within the wellbore 220. In addition, or in the alternative, the wellbore control system 291 may implement the second stage of a gravel pack operation by imposing conditions with the wellbore 220 that reduces voids in the gravel load within the wellbore 220 after the gravel load is released from the gravel containment apparatus (discussed below) of an example gravel pack production string component 230.

The wellbore control system 291 may control the pressure within the wellbore through piping 288 and the wellhead 292. The wellbore control system 291 may include any combination of valves, piping, pumps, sensor devices, compressors, regulators, and/or other components known in the art. In some cases, the wellbore control system 291 may include one or more systems (e.g., a wireline system, a coiled tubing system) that can be deployed down the cavity 228 of the production string 225. The wellhead 292 and the wellbore control system 291 are positioned at or proximate to the surface 208, which may be the ground for land-based projects and the seabed for subsea projects. In some cases, for subsea projects, the surface 208 may be at or slightly above sea level (e.g., on the platform of a drilling rig, on the platform of a floating vessel).

Figure 3A:
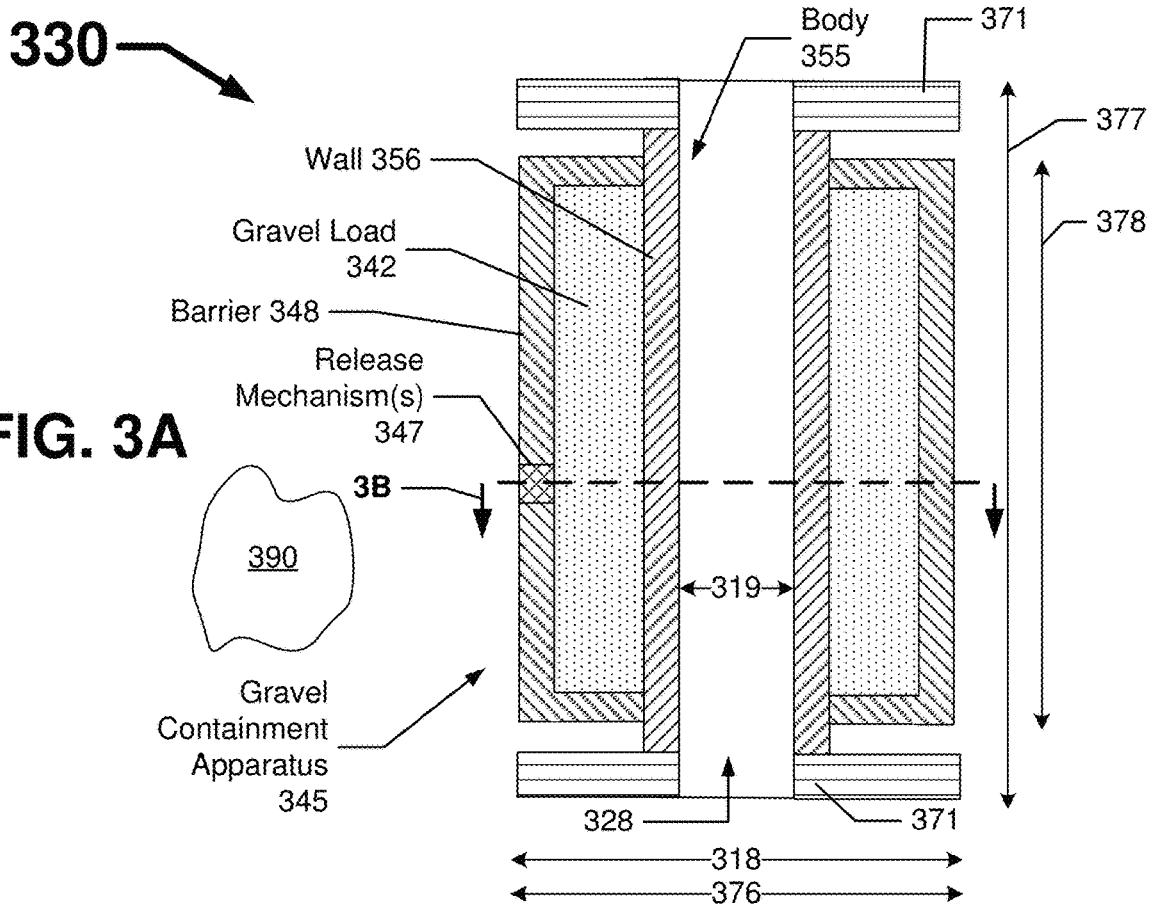
FIGS. 3A and 3B show various views of a general diagram of an example gravel pack production string component according to certain example embodiments.
Figure 3B:
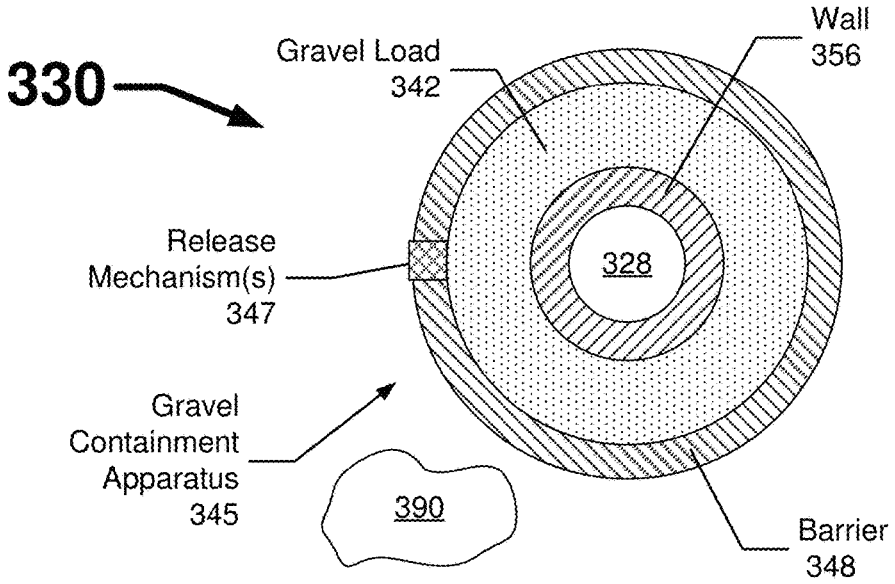

FIGS. 3A and 3B show general diagrams of an example gravel pack production string component 330 according to certain example embodiments. Specifically, FIG. 3A shows a sectional side view of the example gravel pack production string component 330, and FIG. 3B shows a sectional top view of the example gravel pack production string component 330. Referring to the description above with respect to FIGS. 1 and 2, the example gravel pack production string component 330 of FIGS. 3A and 3B capture a point in time prior to the execution of a gravel pack operation within a wellbore (e.g., wellbore 120).

The example gravel pack production string component 330 includes multiple components. For example, as shown in FIGS. 3A and 3B, the example gravel pack production string component 330 may include a body 355, a gravel containment apparatus 345, a gravel load 342, and one or more release mechanisms 347. The body 355 of the example gravel pack production string component 330 includes at least one wall 356 that forms a cavity 328, which becomes part of the annulus (e.g., annulus 223) outside of a production string (e.g., production string 225) when the example gravel pack production string component 330 is coupled (e.g., using coupling features 371 (e.g., mating threads) at the top and bottom ends of the body 355) to another production string component (e.g., another example gravel pack production string component 330, a tubing pipe (e.g., tubing pipe 265)). In this way, the wall 356 may be or include a pipe that conveys the gravel load 342 (also sometimes referred to as a gravel pack) into the wellbore (e.g., wellbore 120, wellbore 220).

As discussed above with respect to FIGS. 1 and 2, the body 355 may be or be part of a component (e.g., a drill pipe, a tubular, a production screen sub) of a production string. Such a component may be standard in the industry or specifically designed for a production operation at a wellbore. Such a component may be manufactured by a third party for use by a user in a wellbore. According to certain example embodiments, the gravel containment apparatus 345 and the release mechanism 347 are added to the body 355 (e.g., at the production site, at a staging area, at a facility specifically designated for incorporating example embodiments outside of the body 355, at a manufacturing facility) for use in a gravel pack operation. Similarly, the gravel load 342 may be a component that is manufactured or produced by a third party. The gravel load 342 is added to (e.g., poured into, mixed with) (e.g., at the production site, at a staging area, at a facility specifically designated for incorporating example embodiments outside of the body 355, at a manufacturing facility) the gravel containment apparatus 345.

In some cases, one or more of the coupling features 371 are integrated with the wall 356 of the body 355. In some such cases, one or both ends of the body 355 that include a coupling feature 371 may have one or more features (e.g., an outer diameter) that may differ from some or all of the wall 356 of the body 355. For example, as shown in FIG. 3A, the parts of the body 355 that include the coupling features 371 at the top and bottom ends of the body 355 have a maximum diameter 376 that is greater than the outer diameter of the wall 356. In some cases, the proximal and distal ends of the wall 356 that are proximate to and/or integrated with the coupling features 371 may also have a maximum diameter 376 that is greater than the outer diameter of the remainder of the wall 356. Examples of this are shown below with respect to FIGS. 13 and 15.

In some cases, the wall 356 of the body 355 is cylindrical in shape. In some cases, the wall 356 of the body 355 may be or include a screen or other form of mesh that is configured to provide fluidic communication therethrough. This would allow for the flow of fluid (e.g., production fluid 195) from an annulus (e.g., annulus 123) to a cavity (e.g., cavity 128) in a production string (e.g., production string 125) in a wellbore (e.g., wellbore 120). Alternatively, the wall 356 of the body 355 may be or include a solid non-permeable material that is configured to provide a fluidic barrier. This would prevent the flow of fluid (e.g., production fluid 295) between an annulus (e.g., annulus 223) and a cavity (e.g., cavity 228) in a production string (e.g., production string 225) in a wellbore (e.g., wellbore 220).

The gravel load 342 of the example gravel pack production string component 330 is or includes gravel that is used in a gravel pack operation to accumulate in and around a wellbore (e.g., wellbore 120, wellbore 220) in order to stop or reduce an amount of formation material (e.g., formation material 194, formation material 294) from flowing into the cavity (e.g., cavity 128, cavity 228) of a production string (e.g., production string 125, production string 225) with production fluids (e.g., production fluids 195, production fluids 295) during a production operation. Before a gravel pack operation is implemented, an example gravel pack production string component 330 that is positioned within a wellbore as part of a production string has a gravel load 342 is disposed around an outer surface of the wall 356 of the body 355. The gravel within the gravel load 342 may be of an appropriate size or range of sizes to stop the movement of formation material while allowing fine particles to pass therethrough. The gravel of the gravel load 342 may be consolidated and/or unconsolidated. The gravel of the gravel load 342 may be or include natural rock (e.g., loose gravel) and/or a produced material (e.g., ceramic beads).

The gravel containment apparatus 345 of the example gravel pack production string component 330 is configured to retain the gravel load 342 in a secure position against the outer surface of the wall 356 of the body 355 as the gravel pack production string component 330, as part of a tubing string (e.g., tubing string 225), is inserted into a wellbore (e.g., wellbore 220). The gravel containment apparatus 345 may have one or more of any of a number of configurations. For example, the gravel containment apparatus 345 may be or include one or more barriers 348 (e.g., a side wall that is parallel to the wall 356 of the body 355, a top wall, a bottom wall) that are coupled to and create a volume of space with the wall 356 of the body 355.

The gravel containment apparatus 345 may have a maximum diameter 376 and a maximum height 378. In this example, the maximum diameter 376 of the gravel containment apparatus 345 is substantially the same as the maximum diameter 318 of the body 355. In alternative embodiments, the maximum diameter 376 of the gravel containment apparatus 345 may larger or smaller than the maximum diameter 318 of the body 355. In addition, in this example, the maximum height 378 of the gravel containment apparatus 345 is less than the height 377 of the body 355. In alternative embodiments, the maximum height 378 of the gravel containment apparatus 345 may be substantially the same as or greater than the height 377 of the body 355. The volume of space created between the one or more barriers 348 of the gravel containment apparatus 345 and the wall 356 of the body 355 are configured to receive and hold the gravel load 342.

While FIGS. 3A and 3B show that the gravel containment apparatus 345 forms a cylinder with a substantially uniform (maximum) diameter 376 along its height 378, in alternative embodiments, the top and bottom ends of the gravel containment apparatus 345 may be sloped or tapered, starting with a minimal diameter proximate to the adjacent coupling feature 371 in the wall 356 and gradually increasing toward the maximum diameter 376. Such a configuration would help prevent the example gravel pack production string component 330, as part of a production string (e.g., production string 125, production string 225), from hanging up on anything as the production string is run into a wellbore. Examples of such a configuration are shown below with respect to FIGS. 14 and 16.

A barrier 348 of the gravel containment apparatus 345 may be or include a screen or other form of mesh that is configured to provide fluidic communication therethrough. Alternatively, a barrier 348 may be or include a solid non-permeable material that is configured to provide a fluidic barrier. As another example, a barrier 348 may be or include a shroud as a means of containing the gravel load 342 in the form of loose gravel. In such cases, the shroud may have solid and/or porous (e.g., mesh) walls, and the shroud may be cylindrical or have some other shape (e.g., graduated outer diameter along some or all of its length). In any case, the barrier 348 is configured to prevent substantially all of the gravel load 342 from traversing therethrough.

As another example, the gravel containment apparatus 345 may be or include a barrier in the form of a solidified version of a liquid that is mixed with the gravel load 342 before solidifying. In such a case, the mixture of the gravel load 342 and the barrier 348 of the gravel containment apparatus 345 may be formed around the wall 356 of the body 355 and set to solidify. Once the mixture of the gravel load 342 and the barrier 348 of the gravel containment apparatus 345 has solidified, the example gravel pack production string component 330 may be added to a production string and inserted into a wellbore.

When the barrier 348 is a shroud, the shroud may be manufactured to be soluble in some material (in other words, the shroud may have a release mechanism 347 (e.g., a soluble resin) embedded therein) that could be introduced by circulating the material (a form of release agent 390, discussed below) into the wellbore after the production string is installed. When the release agent 390 (e.g., various acidic materials, or common oil field solvents) interacts with the soluble portion (the release mechanism 347) of the shroud (the barrier 348), the gravel load 342 is released into the wellbore. As an alternative, when the barrier 348 is a shroud, the shroud may be a relatively thin material supported by vertical ribs that form cavities where the gravel load 342 is stored.

As another example, the gravel containment apparatus 345 may be or include a sleeve having an inner diameter that is larger than the outer diameter of the wall 356 of the body 355. In some cases, such a sleeve is a single continuous piece. Alternatively, such a sleeve is made of multiple pieces that are coupled (e.g., hingedly, welded, using coupling features (e.g., rivets, bolts)) to each other. These and other examples of a gravel containment apparatus 345 are shown below with respect to FIGS. 4A through 7C.

The release mechanism 347 of the example gravel pack production string component 330 is configured to release the gravel load 342 from the gravel containment apparatus 345 after the gravel pack production string component 330 is positioned within a wellbore (e.g., wellbore 120) for a gravel pack operation and when the release mechanism 347 interacts with a release agent 390 (external to the example gravel pack production string component 330) in the wellbore. An example gravel pack production string component 330 may have one or multiple release mechanisms 347.

A release mechanism 347 may take on one or more of any of a number of forms. A release mechanism 347 may be a physical device or component on or integrated with the gravel containment apparatus 345. In addition, or in the alternative, a release mechanism 347 may be a characteristic (e.g., scoring, brittleness, sensitivity to certain sonic frequencies, sensitivity to temperatures, chemical composition) in the barrier 348 of the gravel containment apparatus 345 that is configured to respond to a condition (e.g., a pressure excursion, a temperature excursion, vibrations, the presence of certain fluids (e.g., acids)) within the wellbore.

As an example, a release mechanism 347 may be or include a dissolvable, frangible, and/or other type of matrix that is integrated within a barrier 348 of the gravel containment apparatus 345. In such cases, a certain type of release agent 390 that interacts with the release mechanism 347 in the form of the matrix may cause the barrier 348 of the gravel containment apparatus 345 to lose containment of the gravel load 342, allowing the gravel load 342 (as well as, potentially, pieces of the barrier 348) to fall into the wellbore.

As another example, a release mechanism 347 may be or include one or more coupling features on the gravel containment apparatus 345 that is configured to become decoupled upon an occurrence of a condition (e.g., lapse of time, elevated pressure, elevated temperature). In some cases, as discussed below with respect to FIG. 8, a release mechanism 347 in the form of a coupling feature may be operated (e.g., decoupled) using one or more other components, including but not limited to a controller, a transceiver, a timer, a sensor device, and an energy storage device. Examples of a coupling feature serving as a release mechanism 347 may include, but are not limited to, a latch, a hinge, and a clamp. When the release mechanism 347 of an example gravel pack production string component 330 is or includes multiple coupling features, the configuration of one coupling feature may be the same as, or different than, the configuration of one or more of the other coupling features.

While not part of the example gravel pack production string component 330, the release agent 390 impacts the state of the release mechanism 347. In certain example embodiments, the release agent 390 is introduced into a wellbore (e.g., wellbore 120, wellbore 220) by a user (e.g., using a wellbore control system (e.g., wellbore control system 191, wellbore control system 291)) after a production string (e.g., production string 125, production string 225) has been inserted into the wellbore and placed in the proper position for a gravel pack operation. In some cases, there may be multiple release agents 390 used for a gravel pack operation. For example, a release agent 390 in the form of an acid may be used to release gravel loads 342 from gravel pack production string components 330 toward the bottom of a wellbore, and subsequently another release agent 390 in the form of vibrations may be used to release gravel loads 342 from gravel pack production string components 330 higher up in the wellbore.

As another example, different designs of multiple gravel pack production string components 330 in a production string (e.g., production string 125, production string 225) may be used so that one release agent 390 triggers the release mechanism 347 of one or more (but not all) gravel pack production string components 330 to release a gravel load 342, while another release agent 390 triggers the release mechanism 347 of one or more other (but not all) gravel pack production string components 330 to release a gravel load 342. Such a situation may arise, for example, based on reservoir needs.

A release agent 390 may take any of a number of forms. For example, a release agent 390 may be a fluid (e.g., an acidic liquid) that is introduced (e.g., pumped) into a wellbore (e.g., wellbore 120, wellbore 220) from the surface (e.g., surface 108, surface 208) using a wellbore control system (e.g., wellbore control system 191, wellbore control system 291) after a production string (e.g., production string 225) that includes the example gravel pack production string component 330 is inserted into the wellbore. In such a case, the fluid may be configured to dissolve, liquify, and/or otherwise change the state of the gravel containment apparatus 345, thereby releasing the gravel load 342. For example, the release agent 390 may include one or more compounds that react with the chemical composition of the release mechanism 347 of the gravel containment apparatus 345. This reaction causes a change (e.g., convert a solid to a liquid, make more brittle, dissolve) to the release mechanism 347 that breaks down the gravel containment apparatus 345 and allows the gravel load 342 to be released into the wellbore (e.g., down the annulus).

As another example, a release agent 390 may be a physical device (e.g., a gravel load 342 released from an uphole example gravel pack production string component 330 of a production string) or component that is separate from the gravel containment apparatus 345 of a downhole example gravel pack production string component 330. In such a case, the force of the release agent 390 in the form of the falling gravel load from uphole may be sufficient to break the gravel containment apparatus 345 and release the gravel load 342 based on release mechanisms 347 in the form of scoring, brittleness, thinness, and/or one or more other characteristics of the barrier 348 of the gravel containment apparatus 345.

As yet another example, a release agent 390 may be or include a pressure that is applied to a wellbore (e.g., wellbore 120, wellbore 220) from the surface (e.g., surface 108, surface 208) using a wellbore control system (e.g., wellbore control system 191, wellbore control system 291) after a production string (e.g., production string 225) that includes the example gravel pack production string component 330 is inserted into the wellbore. In such a case, a release mechanism 347 in the form of a characteristic (e.g., a susceptibility to pressures above a threshold pressure) in the barrier 348 of the gravel containment apparatus 345 may cause the barrier 348 to break apart within the wellbore when the pressure within the wellbore exceeds a threshold value.

As another example, a release agent 390 may be or include a temperature that is applied to a wellbore (e.g., wellbore 120, wellbore 220) using a wellbore control system (e.g., wellbore control system 191, wellbore control system 291) after a production string (e.g., production string 225) that includes the example gravel pack production string component 330 is inserted into the wellbore. The release agent 390 in the form of a temperature may be applied from the surface (e.g., surface 108, surface 208) or from within the wellbore using a tool (e.g., lowered into the wellbore using a wireline, lowered into the wellbore using coiled tubing). In such a case, a release mechanism 347 in the form of a characteristic (e.g., a susceptibility to temperatures (e.g., a melting point) above a threshold temperature) in the barrier 348 of the gravel containment apparatus 345 may cause the barrier 348 to break apart (e.g., melt) within the wellbore when the temperature within the wellbore exceeds a threshold value.

As another example, a release agent 390 may be or include vibrations generated by a vibrating apparatus and applied to a production string that includes an example gravel pack production string component 330. The release agent 390 in the form of vibrations may be applied using a wellbore control system (e.g., wellbore control system 191, wellbore control system 291) after a production string (e.g., production string 225) that includes the example gravel pack production string component 330 is inserted into the wellbore. Such vibrations may have any of a number of characteristics (e.g., high frequency, low frequency, irregular frequency, high amplitude, low amplitude, irregular amplitude). The vibrations may be applied from the surface (e.g., surface 108, surface 208) or from within the wellbore using a tool (e.g., lowered into the wellbore using a wireline, lowered into the wellbore using coiled tubing). In such a case, a release mechanism 347 in the form of a characteristic (e.g., a susceptibility to vibrations above a threshold amplitude, a susceptibility to vibrations above a threshold frequency) in the barrier 348 of the gravel containment apparatus 345 may cause the barrier 348 to break apart (e.g., melt) within the wellbore when the vibrations exceeds a threshold value.

As yet another example, a release agent 390 may be or include sound or other types of acoustic waves that are generated and applied within the wellbore when the production string that includes an example gravel pack production string component 330 is disposed therein. The release agent 390 in the form of sound or other types of acoustic waves may be applied using a wellbore control system (e.g., wellbore control system 191, wellbore control system 291) after a production string (e.g., production string 225) that includes the example gravel pack production string component 330 is inserted into the wellbore. The sound or other types of acoustic waves may be applied from the surface (e.g., surface 108, surface 208) or from within the wellbore using a tool (e.g., lowered into the wellbore using a wireline, lowered into the wellbore using coiled tubing). In such a case, a release mechanism 347 in the form of a characteristic (e.g., a susceptibility to sounds above a certain frequency and/or amplitude) in the barrier 348 of the gravel containment apparatus 345 may cause the barrier 348 to break apart within the wellbore when the sound or other types of acoustic waves exceeds a threshold value.

Before being used in a gravel pack operation, each example gravel pack production string component 330 has an inner diameter 319 (defined by the inner surface of the wall 356 of the body 355) and a maximum diameter 318. The measure of the maximum diameter 318 may be defined by the outer diameter of the wall 356. More often, however, the maximum diameter 318 may be defined by the outer diameter of the coupling features 371 disposed at each end of the wall 356. Because the gravel pack operation using example gravel pack production string components 330 does not involve dropping gravel or injecting a gravel slurry down the wellbore from the surface (e.g., surface 108, surface 208), less clearance between the outer diameter of the gravel pack production string component 330 and the casing string (e.g., casing string 121) or the open hole boundary, as appropriate. As a result, the maximum diameter 376 of the gravel containment apparatus 345 may be larger than the maximum diameter 318. In some cases, the maximum diameter 318 and/or the maximum diameter 376 may be limited by considerations for swab or surge concerns while installing the completion equipment.

Figure 4A:
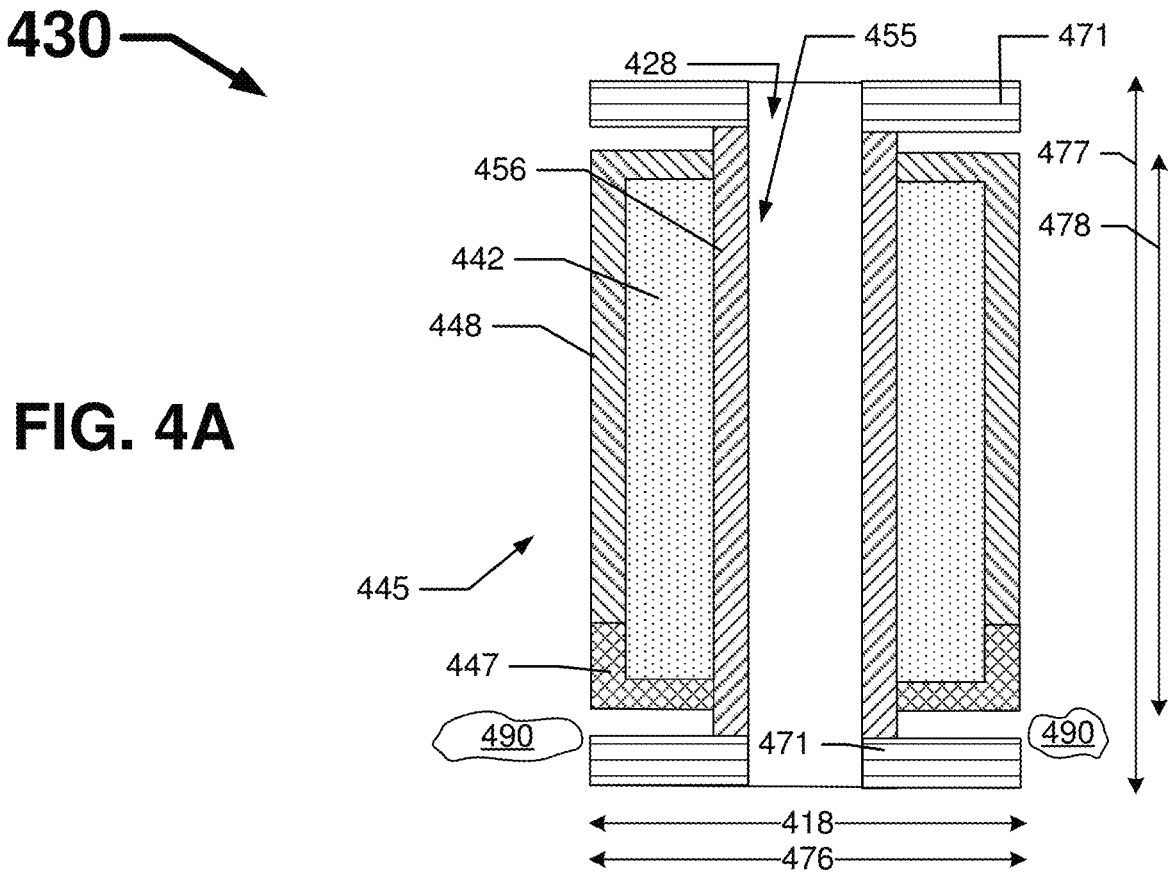
FIGS. 4A through 4C show sectional views of an operational sequence of an example gravel pack production string component according to certain example embodiments.
Figure 4B:
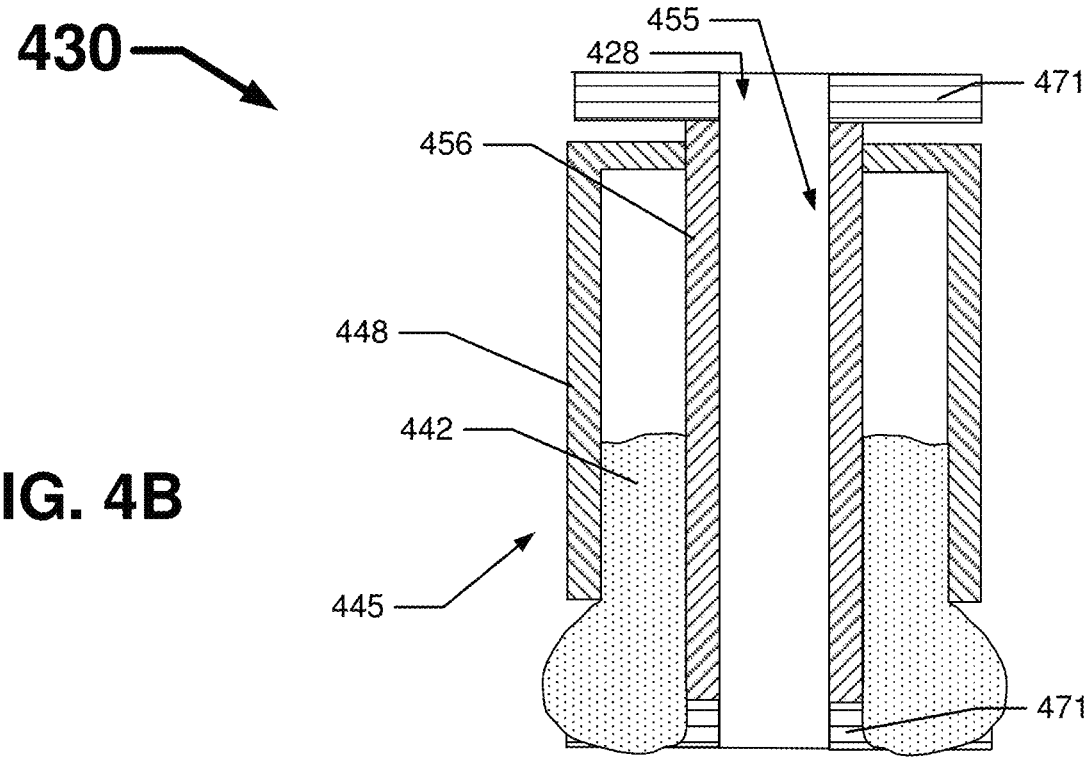
Figure 4C:
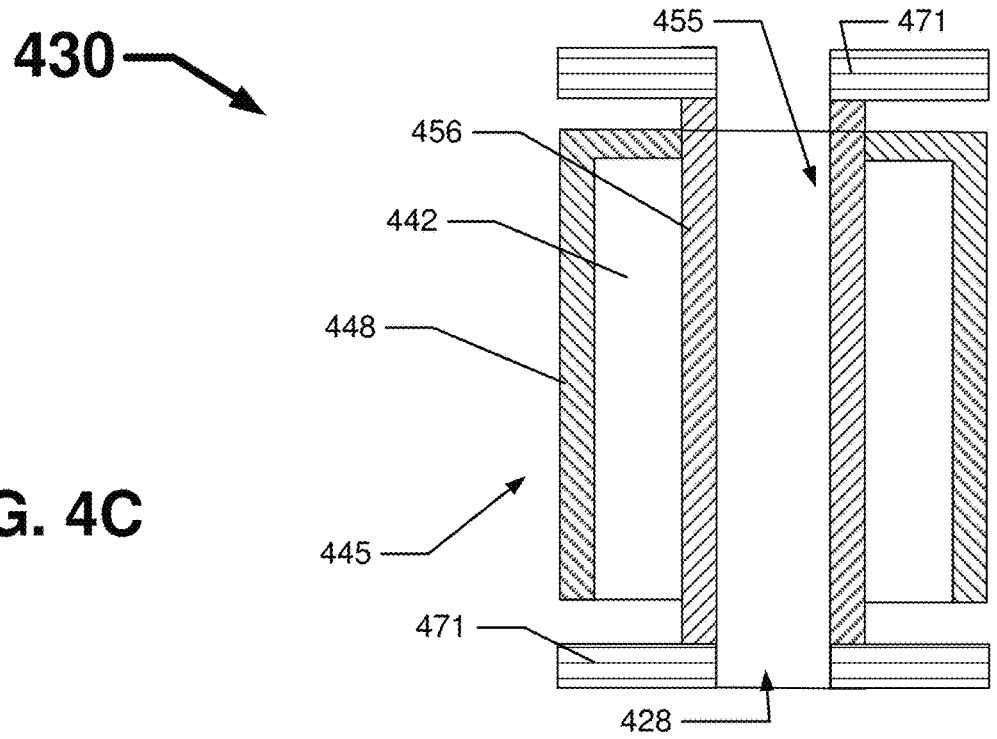

FIGS. 4A through 4C show sectional views of an operational sequence of an example gravel pack production string component 430 according to certain example embodiments. Specifically, FIG. 4A shows the gravel pack production string component 430 before interacting with a release agent 490. FIG. 4B shows the gravel pack production string component 430 while interacting with the release agent 490. FIG. 4C shows the gravel pack production string component 430 after interacting with the release agent 490.

Referring to the description above with respect to FIGS. 1 through 3B, the gravel pack production string component 430 (including its various components) and the release agent 490 may be substantially the same as the example gravel pack production string component 330 (including its corresponding components) and the release agent 390 discussed above. For example, before interacting with the release agent 490, the gravel pack production string component 430 includes a body 455, a gravel containment apparatus 445 that contains a gravel load 442, and a release mechanism 447 that is configured to release the gravel load 442 after interacting with the release agent 490.

The body 455 of the example gravel pack production string component 430 includes a cylindrical wall 456 that forms a cavity 428, which becomes part of the annulus (e.g., annulus 223) outside of a production string (e.g., production string 225) when the example gravel pack production string component 430 is coupled (e.g., using coupling features 471 (e.g., mating threads) at the top and bottom ends of the body 455) to another production string component (e.g., another example gravel pack production string component 330, a tubing pipe (e.g., tubing pipe 265)). In this example, the coupling features 471 are integrated with the wall 456 of the body 455.

In some cases, one or both ends of the body 455 that include a coupling feature 471 may have one or more features (e.g., an outer diameter) that may differ from some or all of the wall 456 of the body 455. For example, as shown in FIG. 4A, the parts of the body 455 that include the coupling features 471 at the top and bottom ends of the body 455 have a maximum diameter 476 that is greater than the outer diameter of the wall 456. In some cases, the proximal and distal ends of the wall 456 that are proximate to and/or integrated with the coupling features 471 may also have a maximum diameter 476 that is greater than the outer diameter of the remainder of the wall 456. Examples of this are shown below with respect to FIGS. 13 and 15.

The wall 456 of the body 455 may be or include a screen or other form of mesh that is configured to provide fluidic communication therethrough. Alternatively, the wall 456 of the body 455 may be or include a solid non-permeable material (e.g., a screen) that is configured to provide a fluidic barrier. In such cases, the gravel load 442 and the gravel containment apparatus 445 may take the place of a sleeve that is used in the current art with subs that include screens, where the sleeve covers the screen until the sub is placed within the wellbore, and where the sleeve is moved so that the screen is exposed to the wellbore when the gravel pack operation is ready to begin. In this way, the use of example the gravel pack production string component 430 (including any variation thereof discussed herein) further simplifies a traditional gravel pack operation by not requiring a movable sleeve and a mechanism for moving the sleeve for screen subs. The gravel load 442 of the example gravel pack production string component 430 is or includes gravel that is used in a gravel pack operation.

The gravel containment apparatus 445 of the example gravel pack production string component 430 is configured to retain the gravel load 442 in a secure position against the outer surface of the wall 456 of the body 455 as the gravel pack production string component 430, as part of a tubing string (e.g., tubing string 225), is inserted into a wellbore (e.g., wellbore 220). In this example, the gravel containment apparatus 445 includes barriers 448 in the form of a side wall that is parallel to the wall 456 of the body 455 and a top wall that joins the top of the side wall with the top of the wall 456 of the body 455.

The gravel containment apparatus 445 may have a maximum diameter 476 and a maximum height 478. In this example, the maximum diameter 476 of the gravel containment apparatus 445 is substantially the same as the maximum diameter 418 of the body 455. In alternative embodiments, the maximum diameter 476 of the gravel containment apparatus 445 may larger or smaller than the maximum diameter 418 of the body 455. In addition, in this example, the maximum height 478 of the gravel containment apparatus 445 is less than the height 477 of the body 455. In alternative embodiments, the maximum height 478 of the gravel containment apparatus 445 may be substantially the same as or greater than the height 477 of the body 455.

While FIGS. 4A through 4C show that the gravel containment apparatus 445 forms a cylinder with a substantially uniform (maximum) diameter 476 along its height 478, in alternative embodiments, the top and bottom ends of the gravel containment apparatus 445 may be sloped or tapered, starting with a minimal diameter proximate to the adjacent coupling feature 471 in the wall 456 and gradually increasing toward the maximum diameter 476. Such a configuration would help prevent the example gravel pack production string component 430, as part of a production string (e.g., production string 125, production string 225), from hanging up on anything as the production string is run into a wellbore. Examples of such a configuration are shown below with respect to FIGS. 14 and 16.

The barriers 448, along with the release mechanism 447 (discussed below) create a volume of space with the wall 456 of the body 455. The volume of space created between the barriers 448, the release mechanism 447, and the wall 456 of the body 455 receive and hold the gravel load 442 before the release mechanism 447 interacts with the release agent 490. A barrier 448 of the gravel containment apparatus 445 may be or include a screen or other form of mesh that is configured to provide fluidic communication therethrough. Alternatively, a barrier 448 may be or include a solid non-permeable material that is configured to provide a fluidic barrier. Either way, the barriers 448 are configured to prevent substantially all of the gravel load 442 from traversing therethrough.

The release mechanism 447 of the example gravel pack production string component 430 is configured to release the gravel load 442 from the gravel containment apparatus 445 when the release mechanism 447 interacts with the release agent 490. In this example, the release mechanism 447 forms a bottom wall and the lowest part of the side wall of the barrier 448 of the gravel containment apparatus 445. The release mechanism 447 in this case is made of a material that is configured to dissolve when making contact with the release agent 490, as shown in FIG. 4B. Eventually, as shown in FIG. 4C, substantially all of the gravel load 442 falls out of the cavity between the body 455 and the barrier 448 of the gravel containment apparatus 445.

The release agent 490 impacts the state of the release mechanism 447. In this example, the release agent 490 is in the form of a fluid (e.g., a gas, a liquid) that causes the release mechanism 447 to liquify and/or disintegrate when the release agent 490 contacts and interacts with the release mechanism 447. For instance, the release agent 490 may be or include an acid that is introduced (e.g., pumped) into a wellbore (e.g., wellbore 120, wellbore 220) from the surface (e.g., surface 108, surface 208) using a wellbore control system (e.g., wellbore control system 191, wellbore control system 291) after a production string (e.g., production string 225) that includes the example gravel pack production string component 430 is inserted into the wellbore. The release agent 490 dissolves, liquifies, and/or otherwise changes the state of the release mechanism 447 of the gravel containment apparatus 445, thereby releasing the gravel load 442.

Figure 5A:
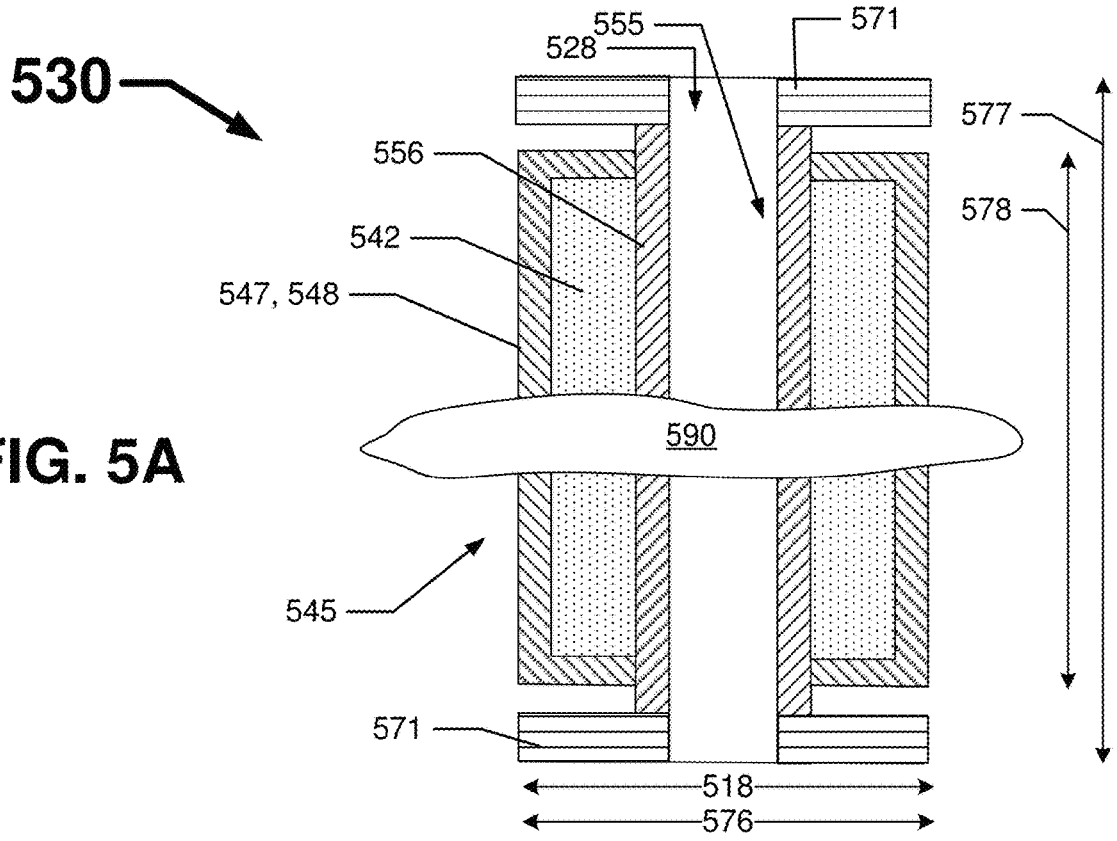
FIGS. 5A through 5C show sectional views of an operational sequence of another example gravel pack production string component according to certain example embodiments.
Figure 5B:
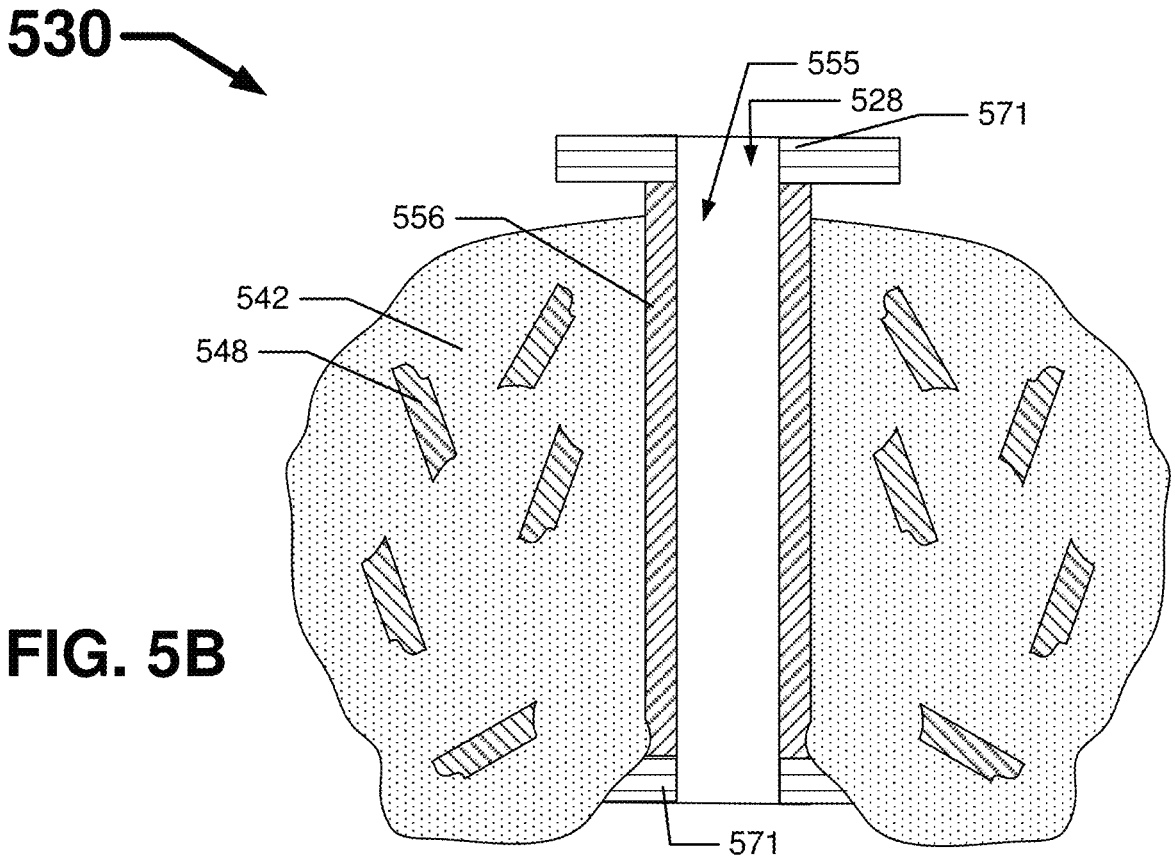
Figure 5C:
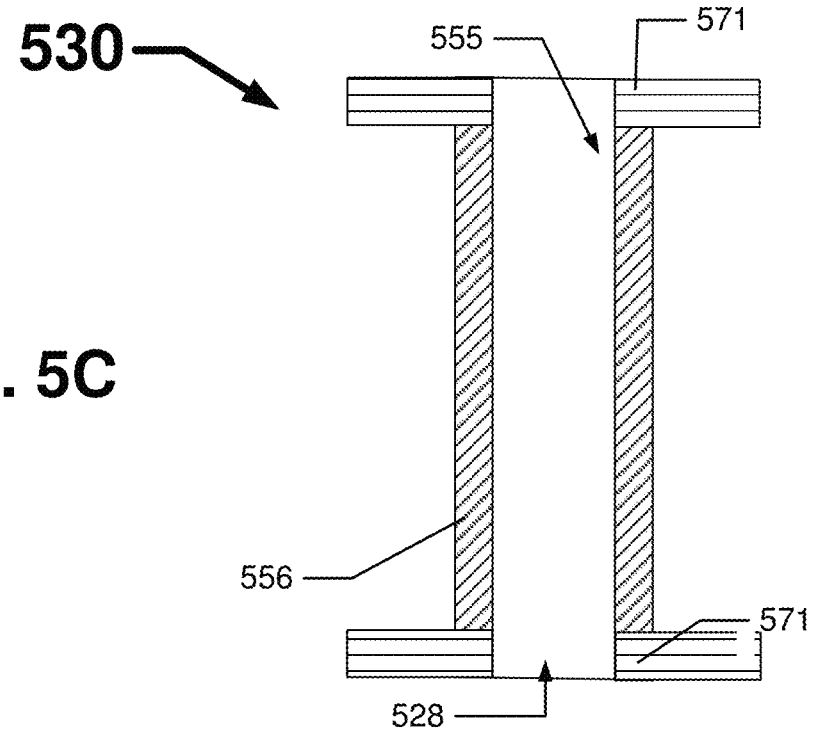

FIGS. 5A through 5C show sectional views of an operational sequence of another example gravel pack production string component 530 according to certain example embodiments. Specifically, FIG. 5A shows the gravel pack production string component 530 before interacting with a release agent 590. FIG. 5B shows the gravel pack production string component 530 while interacting with the release agent 590. FIG. 5C shows the gravel pack production string component 530 after interacting with the release agent 590.

Referring to the description above with respect to FIGS. 1 through 4C, the gravel pack production string component 530 (including its various components) and the release agent 590 may be substantially the same as the example gravel pack production string components (including their corresponding components) and the release agents discussed above. For example, before interacting with the release agent 590, the gravel pack production string component 530 includes a body 555, a gravel containment apparatus 545 that contains a gravel load 542, and a release mechanism 547 that is configured to release the gravel load 542 after interacting with the release agent 590.

The body 555 of the example gravel pack production string component 530 includes a cylindrical wall 556 that forms a cavity 528, which becomes part of the annulus (e.g., annulus 223) outside of a production string (e.g., production string 225) when the example gravel pack production string component 530 is coupled (e.g., using coupling features 571 (e.g., mating threads) at the top and bottom ends of the body 555) to another production string component (e.g., another example gravel pack production string component 330, a tubing pipe (e.g., tubing pipe 265)). In this example, the coupling features 571 are integrated with the wall 556 of the body 555.

In some cases, one or both ends of the body 555 that include a coupling feature 571 may have one or more features (e.g., an outer diameter) that may differ from some or all of the wall 556 of the body 555. For example, as shown in FIG. 5A, the parts of the body 555 that include the coupling features 571 at the top and bottom ends of the body 555 have a maximum diameter 576 that is greater than the outer diameter of the wall 556. In some cases, the proximal and distal ends of the wall 556 that are proximate to and/or integrated with the coupling features 571 may also have a maximum diameter 576 that is greater than the outer diameter of the remainder of the wall 556. Examples of this are shown below with respect to FIGS. 13 and 15.

The wall 556 of the body 555 may be or include a screen or other form of mesh that is configured to provide fluidic communication therethrough. Alternatively, the wall 556 of the body 555 may be or include a solid non-permeable material that is configured to provide a fluidic barrier. The gravel load 542 of the example gravel pack production string component 530 is or includes gravel that is used in a gravel pack operation.

The gravel containment apparatus 545 of the example gravel pack production string component 530 is configured to retain the gravel load 542 in a secure position against the outer surface of the wall 556 of the body 555 as the gravel pack production string component 530, as part of a tubing string (e.g., tubing string 225), is inserted into a wellbore (e.g., wellbore 220). In this example, the gravel containment apparatus 545 includes barriers 548 in the form of a side wall that is parallel to the wall 556 of the body 555, a bottom wall that joins the bottom of the side wall with the top of the wall 556 of the body 555, and a top wall that joins the top of the side wall with the top of the wall 556 of the body 555.

The gravel containment apparatus 545 may have a maximum diameter 576 and a maximum height 578. In this example, the maximum diameter 576 of the gravel containment apparatus 545 is substantially the same as the maximum diameter 518 of the body 555. In alternative embodiments, the maximum diameter 576 of the gravel containment apparatus 545 may larger or smaller than the maximum diameter 518 of the body 555. In addition, in this example, the maximum height 578 of the gravel containment apparatus 545 is less than the height 577 of the body 555. In alternative embodiments, the maximum height 578 of the gravel containment apparatus 545 may be substantially the same as or greater than the height 577 of the body 555.

While FIG. 5A shows that the gravel containment apparatus 545 forms a cylinder with a substantially uniform (maximum) diameter 576 along its height 578, in alternative embodiments, the top and bottom ends of the gravel containment apparatus 545 may be sloped or tapered, starting with a minimal diameter proximate to the adjacent coupling feature 571 in the wall 556 and gradually increasing toward the maximum diameter 576. Such a configuration would help prevent the example gravel pack production string component 530, as part of a production string (e.g., production string 125, production string 225), from hanging up on anything as the production string is run into a wellbore. Examples of such a configuration are shown below with respect to FIGS. 14 and 16.

The barriers 548 create a volume of space with the wall 556 of the body 555. The volume of space created between the barriers 548 and the wall 556 of the body 555 receive and hold the gravel load 542 before the release mechanism 547 interacts with the release agent 590. A barrier 548 of the gravel containment apparatus 545 may be or include a screen or other form of mesh that is configured to provide fluidic communication therethrough. Alternatively, a barrier 548 may be or include a solid non-permeable material that is configured to provide a fluidic barrier. Either way, the barriers 548 are configured to prevent substantially all of the gravel load 542 from traversing therethrough.

The release mechanism 547 of the example gravel pack production string component 530 is configured to release the gravel load 542 from the gravel containment apparatus 545 when the release mechanism 547 interacts with the release agent 590. In this example, the release mechanism 547 is integrated with some or all of the barriers 548 of the gravel containment apparatus 545. For example, the release mechanism 547 may form a matrix among the matrix of the barriers 548. As another example, the release mechanism 547 may form segments within the barriers 548.

The release mechanism 547 may take on one or more of a number of forms in this case. For example, the release mechanism 547 may be or include a material, different than the material of the barriers 548, having a chemical composition that is configured to dissolve when making contact with the release agent 590. As another example, the release mechanism 547 may be or include a characteristic (e.g., scoring, brittleness, sensitivity to certain sonic frequencies, sensitivity to temperatures) in the barriers 548 that is configured to respond to certain types of a release agent 590 (e.g., a release agent 590 in the form of a pressure excursion, a release agent 590 in the form of a temperature excursion, a release agent 590 in the form of vibrations, a release agent 590 in the form of a sonic pulse). As yet another example, the release mechanism 547 may be or include an explosive that is triggered by a release agent 590 (e.g., in the form of a timer, in the form of a chemical, in the form of a vibration or sound having a particular frequency).

As a result, as shown in FIG. 5B, in addition to the gravel load 542 falling downhole, pieces of the barriers 548 also fall downhole. Eventually, as shown in FIG. 5C, substantially all of the gravel load 542 and the pieces of the barriers 548 fall out of the cavity between the body 555 and the barriers 548 of the gravel containment apparatus 545, and ultimately substantially none of the gravel containment apparatus 545 remains attached to the body 555. While the pieces of the barriers 548 are shown in FIG. 5B to be relatively large so that they are easier to see in the drawing, in practice the pieces of the barriers 548 may be substantially the same size as the gravel load 542. In this way, issues such as bridging in the annulus (which could impact the effectiveness of the gravel pack operation) and the operation of other gravel pack production string components may be avoided.

The release agent 590 impacts the state of the release mechanism 547. In this example, the release agent 590 may take one or more of any of a number of forms, including, but not limited to, a fluid (e.g., a gas, a liquid) that causes the release mechanism 547 to liquify and/or disintegrate when the release agent 590 contacts and interacts with the release mechanism 547, a pressure excursion, a temperature excursion, vibrations applied to the gravel pack production string component 530, an electrical current, and a sonic pulse. In any case, the release agent 590 is introduced into a wellbore (e.g., wellbore 120, wellbore 220) (e.g., from the surface (e.g., surface 108, surface 208), within the wellbore using a wireline or coiled tubing system) using a wellbore control system (e.g., wellbore control system 191, wellbore control system 291) after a production string (e.g., production string 225) that includes the example gravel pack production string component 530 is inserted into the wellbore. The release agent 590 dissolves, liquifies, breaks apart, and/or otherwise changes the state of the release mechanism 547 of the gravel containment apparatus 545, thereby releasing the gravel load 542.

Figure 6A:
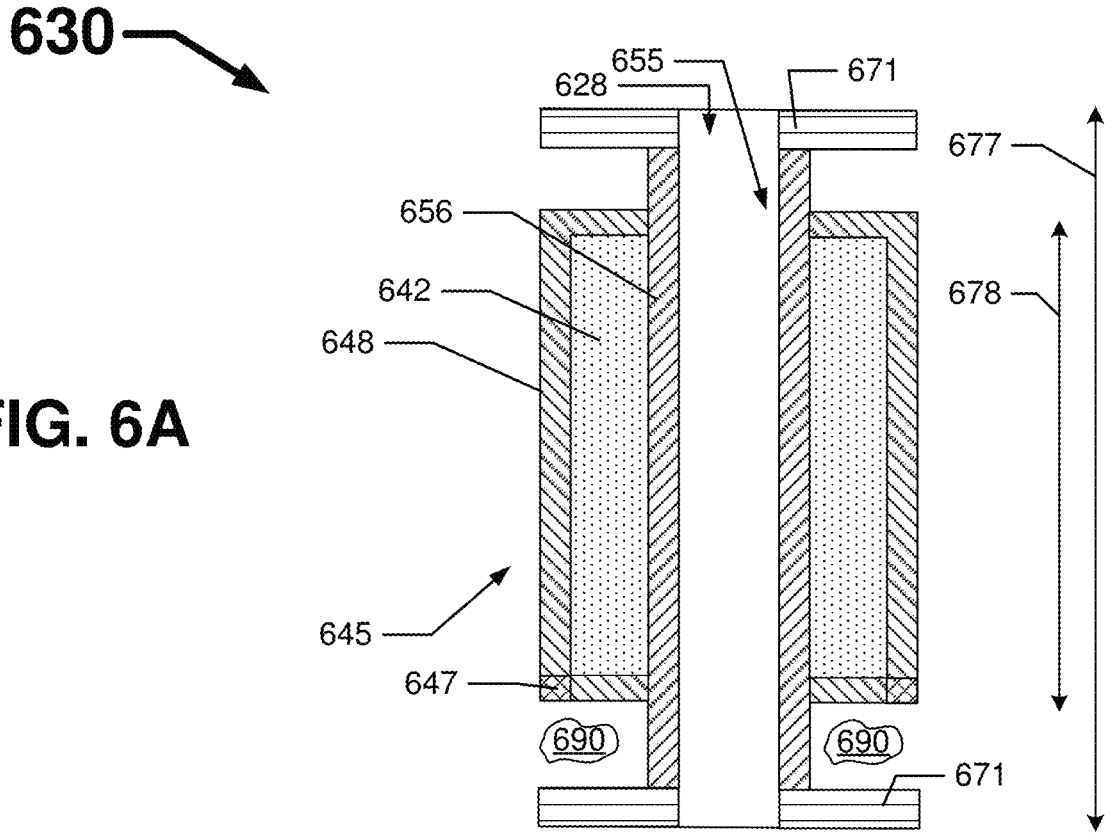
FIGS. 6A through 6C show sectional views of an operational sequence of another example gravel pack production string component according to certain example embodiments.
Figure 6B:
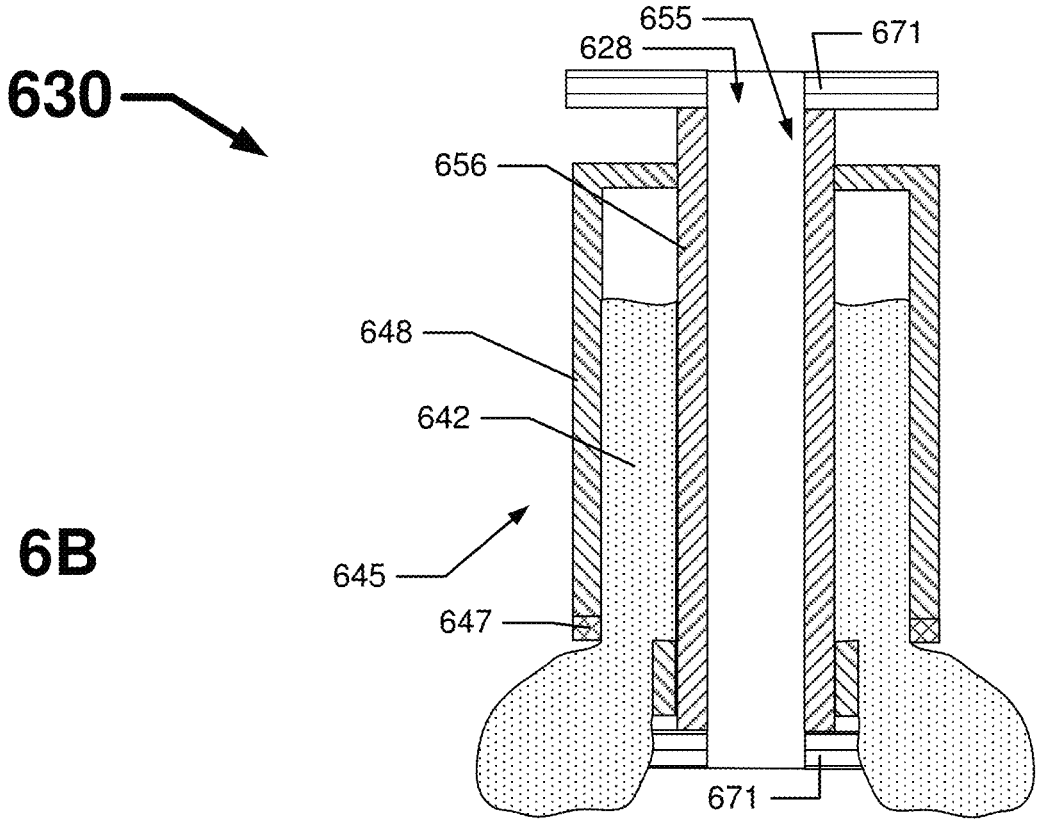
Figure 6C:
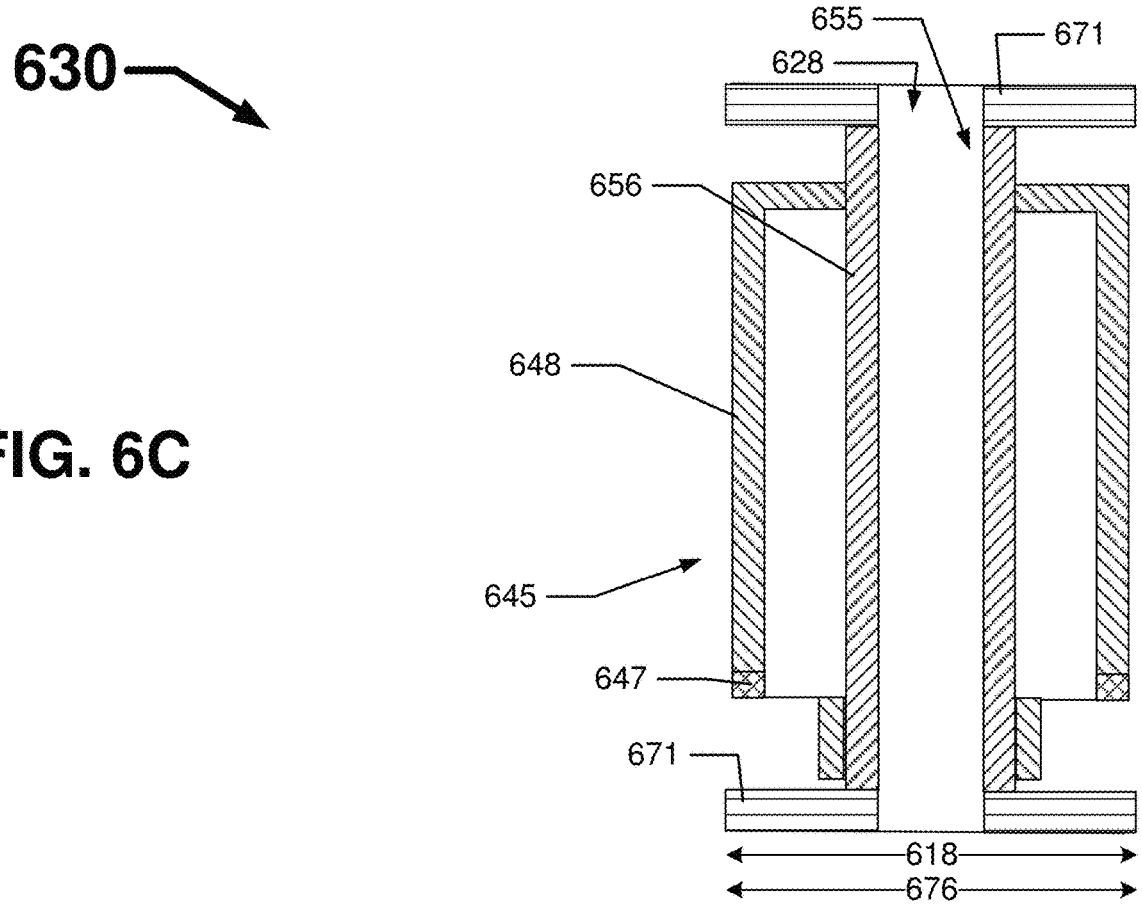

FIGS. 6A through 6C show sectional views of an operational sequence of another example gravel pack production string component 630 according to certain example embodiments. Specifically, FIG. 6A shows the gravel pack production string component 630 before interacting with a release agent 690. FIG. 6B shows the gravel pack production string component 630 while interacting with the release agent 690. FIG. 6C shows the gravel pack production string component 630 after interacting with the release agent 690.

Referring to the description above with respect to FIGS. 1 through 5C, the gravel pack production string component 630 (including its various components) and the release agent 690 may be substantially the same as the example gravel pack production string components (including their corresponding components) and the release agents discussed above. For example, before interacting with the release agent 690, the gravel pack production string component 630 includes a body 655, a gravel containment apparatus 645 that contains a gravel load 642, and a release mechanism 647 that is configured to release the gravel load 642 after interacting with the release agent 690.

The body 655 of the example gravel pack production string component 630 includes a cylindrical wall 656 that forms a cavity 628, which becomes part of the annulus (e.g., annulus 223) outside of a production string (e.g., production string 225) when the example gravel pack production string component 630 is coupled (e.g., using coupling features 671 (e.g., mating threads) at the top and bottom ends of the body 655) to another production string component (e.g., another example gravel pack production string component 330, a tubing pipe (e.g., tubing pipe 265)). In this example, the coupling features 671 are integrated with the wall 656 of the body 655.

In some cases, one or both ends of the body 655 that include a coupling feature 671 may have one or more features (e.g., an outer diameter) that may differ from some or all of the wall 656 of the body 655. For example, as shown in FIGS. 6A through 6C, the parts of the body 655 that include the coupling features 671 at the top and bottom ends of the body 655 have a maximum diameter 676 that is greater than the outer diameter of the wall 656. In some cases, the proximal and distal ends of the wall 656 that are proximate to and/or integrated with the coupling features 671 may also have a maximum diameter 676 that is greater than the outer diameter of the remainder of the wall 656. Examples of this are shown below with respect to FIGS. 13 and 15.

The wall 656 of the body 655 may be or include a screen or other form of mesh that is configured to provide fluidic communication therethrough. Alternatively, the wall 656 of the body 655 may be or include a solid non-permeable material that is configured to provide a fluidic barrier. The gravel load 642 of the example gravel pack production string component 630 is or includes gravel that is used in a gravel pack operation.

The gravel containment apparatus 645 of the example gravel pack production string component 630 is configured to retain the gravel load 642 in a secure position against the outer surface of the wall 656 of the body 655 as the gravel pack production string component 630, as part of a tubing string (e.g., tubing string 225), is inserted into a wellbore (e.g., wellbore 220). In this example, the gravel containment apparatus 645 includes barriers 648 in the form of a side wall that is parallel to the wall 656 of the body 655, a bottom wall that joins the bottom of the side wall with the top of the wall 656 of the body 655, and a top wall that joins the top of the side wall with the top of the wall 656 of the body 655.

The gravel containment apparatus 645 may have a maximum diameter 676 and a maximum height 678. In this example, the maximum diameter 676 of the gravel containment apparatus 645 is substantially the same as the maximum diameter 618 of the body 655. In alternative embodiments, the maximum diameter 676 of the gravel containment apparatus 645 may larger or smaller than the maximum diameter 618 of the body 655. In addition, in this example, the maximum height 678 of the gravel containment apparatus 645 is less than the height 677 of the body 655. In alternative embodiments, the maximum height 678 of the gravel containment apparatus 645 may be substantially the same as or greater than the height 677 of the body 655.

While FIGS. 6A through 6C show that the gravel containment apparatus 645 forms a cylinder with a substantially uniform (maximum) diameter 676 along its height 678, in alternative embodiments, the top and bottom ends of the gravel containment apparatus 645 may be sloped or tapered, starting with a minimal diameter proximate to the adjacent coupling feature 671 in the wall 656 and gradually increasing toward the maximum diameter 676. Such a configuration would help prevent the example gravel pack production string component 630, as part of a production string (e.g., production string 125, production string 225), from hanging up on anything as the production string is run into a wellbore. Examples of such a configuration are shown below with respect to FIGS. 14 and 16.

The barriers 648 create a volume of space with the wall 656 of the body 655. The volume of space created between the barriers 648 and the wall 656 of the body 655 receive and hold the gravel load 642 before the release mechanism 647 interacts with the release agent 690. A barrier 648 of the gravel containment apparatus 645 may be or include a screen or other form of mesh that is configured to provide fluidic communication therethrough. Alternatively, a barrier 648 may be or include a solid non-permeable material that is configured to provide a fluidic barrier. Either way, the barriers 648 are configured to prevent substantially all of the gravel load 642 from traversing therethrough.

The release mechanism 647 of the example gravel pack production string component 630 is configured to release the gravel load 642 from the gravel containment apparatus 645 when the release mechanism 647 interacts with the release agent 690. In this example, the release mechanism 647 includes a coupling feature (e.g., a latch) where the bottom wall meets the side wall of the barrier 648. The release mechanism in this case also includes a hinge or similar coupling feature between the bottom wall of the barrier 648 and the wall 656 of the body 655.

The release mechanism 647 may take on one or more of a number of forms in this case. For example, the release mechanism 647 may be or include a material having a chemical composition that is configured to dissolve when making contact with the release agent 690. As another example, the release mechanism 647 may be or include a characteristic (e.g., scoring, brittleness, sensitivity to certain sonic frequencies, sensitivity to temperatures) in the barriers 648 that is configured to respond to certain types of a release agent 690 (e.g., a release agent 690 in the form of a pressure excursion, a release agent 690 in the form of a temperature excursion, a release agent 690 in the form of vibrations, a release agent 690 in the form of a sonic pulse).

As yet another example, the release agent 690 may be or include one or more components (e.g., a timer, a controller, a sensor device, an energy storage device, a transceiver) discussed below with respect to FIG. 8. In this way, the release agent 690 may activate using electronics responding to a release agent 690 in the form of, for example, a communication signal (e.g., sent through fluids in the wellbore), an electrical pulse, the passage of time, a temperature excursion, a pressure excursion, a vibration, and a sonic pulse. As a result, when the release agent 690 allows the bottom wall of the barrier 648 to swing away, as shown in FIG. 6B, the gravel load 642 falls downhole. Eventually, as shown in FIG. 6C, substantially all of the gravel load 642 falls out of the cavity between the body 655 and the side and top walls of the barriers 648 of the gravel containment apparatus 645.

The release agent 690 impacts the state of the release mechanism 647. In this example, the release agent 690 may take one or more of any of a number of forms, including, but not limited to, a fluid (e.g., a gas, a liquid) that causes the release mechanism 647 to liquify and/or disintegrate when the release agent 690 contacts and interacts with the release mechanism 647, a pressure excursion, a temperature excursion, vibrations applied to the gravel pack production string component 630, an electrical current, a sonic pulse, a communication signal, and the passage of time. In any case, the release agent 690 is introduced into a wellbore (e.g., wellbore 120, wellbore 220) (e.g., from the surface (e.g., surface 108, surface 208), within the wellbore using a wireline or coiled tubing system) using a wellbore control system (e.g., wellbore control system 191, wellbore control system 291) after a production string (e.g., production string 225) that includes the example gravel pack production string component 630 is inserted into the wellbore. The release agent 690 dissolves, liquifies, breaks apart, releases, and/or otherwise changes the state of the release mechanism 647 of the gravel containment apparatus 645, thereby releasing the gravel load 642.

Figure 7A:
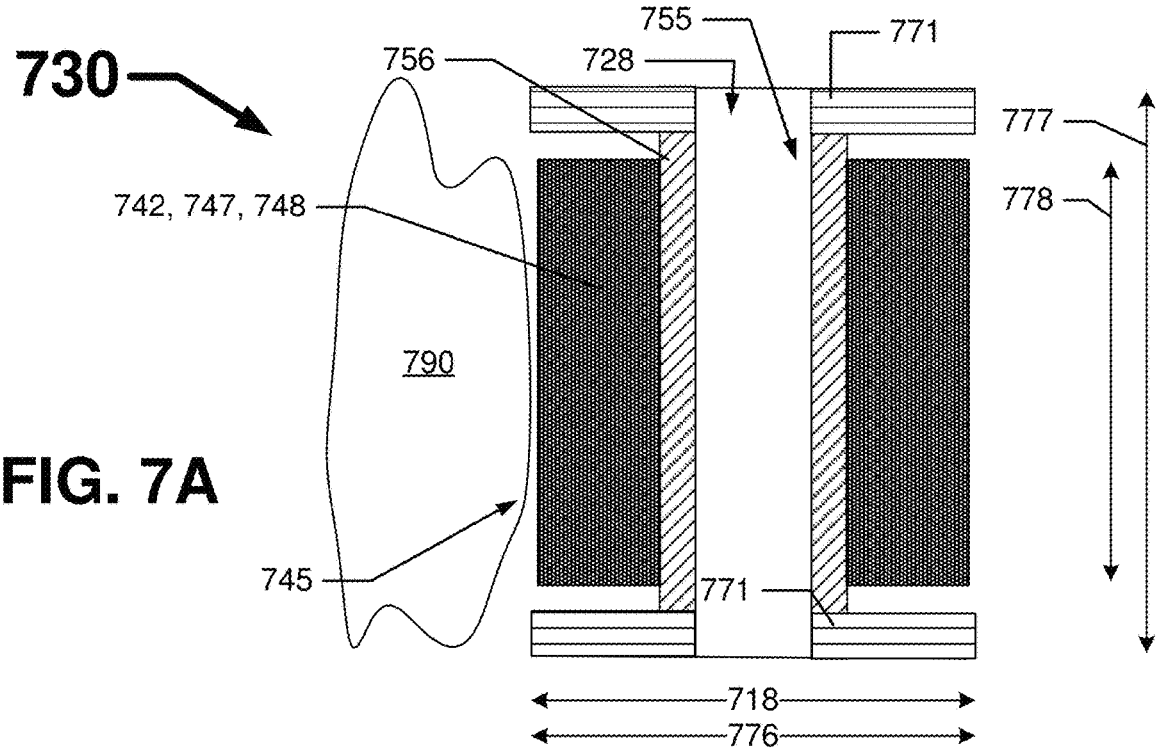
FIGS. 7A through 7C show sectional views of an operational sequence of another example gravel pack production string component according to certain example embodiments.
Figure 7B:
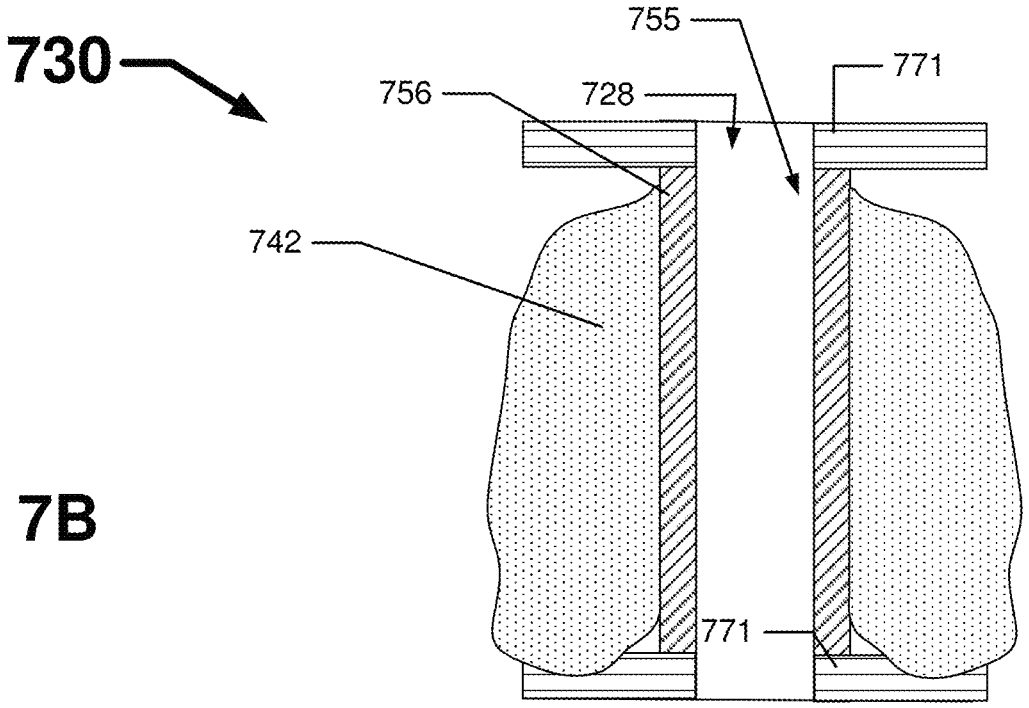
Figure 7C:
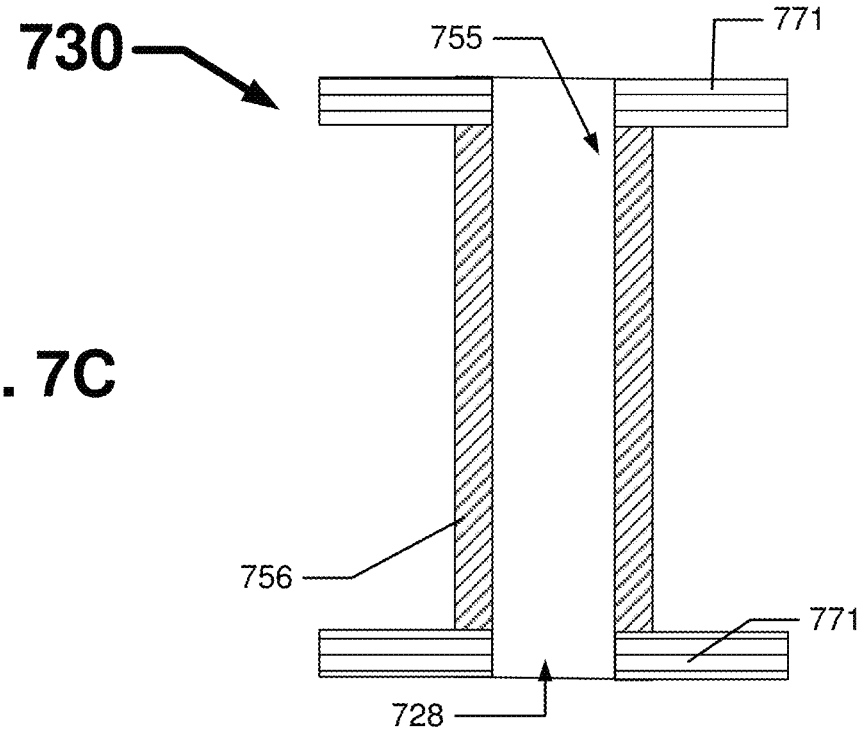

FIGS. 7A through 7C show sectional views of an operational sequence of another example gravel pack production string component 730 according to certain example embodiments. Specifically, FIG. 7A shows the gravel pack production string component 730 before interacting with a release agent 790. FIG. 7B shows the gravel pack production string component 730 while interacting with the release agent 790. FIG. 7C shows the gravel pack production string component 730 after interacting with the release agent 790.

Referring to the description above with respect to FIGS. 1 through 6C, the gravel pack production string component 730 (including its various components) and the release agent 790 may be substantially the same as the example gravel pack production string components (including their corresponding components) and the release agents discussed above. For example, before interacting with the release agent 790, the gravel pack production string component 730 includes a body 755, a gravel containment apparatus 745 that contains a gravel load 742, and a release mechanism 747 that is configured to release the gravel load 742 after interacting with the release agent 790.

The body 755 of the example gravel pack production string component 730 includes a cylindrical wall 756 that forms a cavity 728, which becomes part of the annulus (e.g., annulus 223) outside of a production string (e.g., production string 225) when the example gravel pack production string component 730 is coupled (e.g., using coupling features 771 (e.g., mating threads) at the top and bottom ends of the body 755) to another production string component (e.g., another example gravel pack production string component 330, a tubing pipe (e.g., tubing pipe 265)). In this example, the coupling features 771 are integrated with the wall 756 of the body 755.

The wall 756 of the body 755 may be or include a screen or other form of mesh that is configured to provide fluidic communication therethrough. Alternatively, the wall 756 of the body 755 may be or include a solid non-permeable material that is configured to provide a fluidic barrier. The gravel load 742 of the example gravel pack production string component 730 is or includes gravel that is used in a gravel pack operation.

The gravel containment apparatus 745 of the example gravel pack production string component 730 is configured to retain the gravel load 742 in a secure position against the outer surface of the wall 756 of the body 755 as the gravel pack production string component 730, as part of a tubing string (e.g., tubing string 225), is inserted into a wellbore (e.g., wellbore 220). In this example, the gravel containment apparatus 745 includes a barrier 748 in the form of a liquid that mixes with the gravel load 742 and subsequently solidifies around the wall 756 of the body 755. In some alternative embodiments, the gravel containment apparatus 745 may additionally include a sleeve that is disposed around the solidified mixture of the barrier 748, the gravel load 742, and the release mechanism 747.

The release mechanism 747 of the example gravel pack production string component 730 is configured to release the gravel load 742 from the gravel containment apparatus 745 when the release mechanism 747 interacts with the release agent 790. In this example, the release mechanism 747 is a chemical compound integrated with the barrier 748, both in liquid and solid forms. For example, the release mechanism 747 may be or include a material having a chemical composition that is configured to return the barrier 748 to a liquid state when making contact with the release agent 790.

As another example, the gravel load 742 may be "glued" in place over the wall 756, where the glue (or similar type of chemical compound) acts as both a barrier 748 and a release mechanism 747. The glue (or similar type of chemical compound), with the gravel load 742 submerged therein, may harden before the gravel pack production string component 730 is added to the production string and inserted into a wellbore. This allows the gravel containment apparatus 745 to encapsulate the gravel load 742 around the wall 756. When the initial stage of the gravel pack operation is ready to begin, a specific solvent may be injected into the wellbore, and a component of the glue (or similar chemical compound) may melt, dissolve, and/or otherwise act as a release mechanism 747 to release the gravel load 742 into the wellbore below the gravel pack production string component 730.

As yet another example, the gravel load 742 may be slurried into an acid soluble cement, resin, and/or other material that is applied over the wall 756. In this way, the acid soluble cement acts as both a barrier 748 and a release mechanism 747. The acid soluble cement, with the gravel load 742 submerged therein, may harden before the gravel pack production string component 730 is added to the production string and inserted into a wellbore. This allows the gravel containment apparatus 745 to encapsulate the gravel load 742 around the wall 756. When the initial stage of the gravel pack operation is ready to begin, an acid may be injected into the wellbore, and the acid soluble cement may liquify, acting as a release mechanism 747 to release the gravel load 742 into the wellbore below the gravel pack production string component 730.

As another example, the release mechanism 747 may be or include a characteristic (e.g., scoring, brittleness, sensitivity to certain sonic frequencies, sensitivity to temperatures) in the solidified barrier 748 that is configured to respond to certain types of a release agent 790 (e.g., a release agent 790 in the form of a pressure excursion, a release agent 790 in the form of a temperature excursion, a release agent 790 in the form of vibrations, a release agent 790 in the form of a sonic pulse). In any case, when the release agent 790 interacts with the release agent 790, as shown in FIG. 7B, the gravel load 742 falls downhole. Eventually, as shown in FIG. 7C, substantially all of the gravel load 742 and the barrier 748 fall away from the wall 756 of the body 755, and ultimately substantially none of the gravel containment apparatus 745 remains attached to the body 755.

The release agent 790 impacts the state of the release mechanism 747. In this example, the release agent 790 may take one or more of any of a number of forms, including, but not limited to, a fluid (e.g., a gas, a liquid) that causes the release mechanism 747 (as well as the barrier 748) to liquify and/or disintegrate when the release agent 790 contacts and interacts with the release mechanism 747, a pressure excursion, a temperature excursion, vibrations applied to the gravel pack production string component 730, and a sonic pulse. In any case, the release agent 790 is introduced into a wellbore (e.g., wellbore 120, wellbore 220) (e.g., from the surface (e.g., surface 108, surface 208), within the wellbore using a wireline or coiled tubing system) using a wellbore control system (e.g., wellbore control system 191, wellbore control system 291) after a production string (e.g., production string 225) that includes the example gravel pack production string component 730 is inserted into the wellbore. The release agent 790 dissolves, liquifies, breaks apart, releases, and/or otherwise changes the state of the release mechanism 747 (and so also the barrier 748) of the gravel containment apparatus 745, thereby releasing the gravel load 742.

For any embodiments of an example gravel pack production string component discussed herein, the gravel load may be added to the gravel containment apparatus on the job site, at a manufacturing facility, at a distribution center, at a warehouse, and/or at some other location. In this way, each example gravel containment apparatus can be customized (e.g., characteristics of the wall of the body, type of release agent required to interact with the release mechanism, outer diameter) for each component of a production string for a particular wellbore with a particular production zone.

Figure 8:
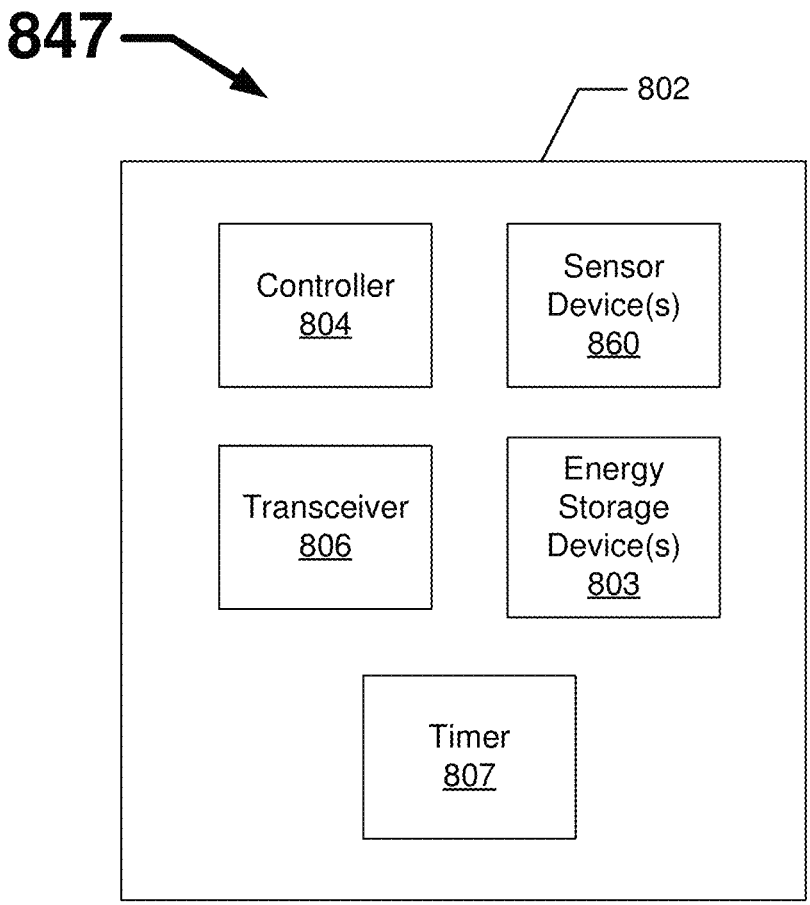
FIG. 8 shows a block diagram of a release mechanism of an example gravel pack production string component according to certain example embodiments.

FIG. 8 shows a block diagram of a release mechanism 847 of an example gravel pack production string component according to certain example embodiments. Referring to the description above with respect to FIGS. 1 through 7C, the release mechanism 847 of FIG. 8 may be substantially similar to the release mechanisms discussed above. In this case, the release mechanism 847 includes a controller 804, a transceiver 806, a timer 807, one or more energy storage devices 803, and one or more sensor devices 860. Embodiments of the release mechanism 847 of FIG. 8 may be used when the operation of the release mechanism 847 involves electrical and/or electronic functionality. Some of the components of the release mechanism 847 may be optional. In addition, or in the alternative, the release mechanism 847 may include one or more additional components or modules in order to achieve electrical and/or electronic functionality. In this case, the components of the release mechanism 847 are shown within a housing 802, although in alternative embodiments one or more of the components of the release mechanism 847 may be disposed on or outside of the housing 802.

The controller 804 may be configured to control and/or communicate with the transceiver 806, the timer 807, the one or more energy storage devices 803, the one or more sensor devices 860, and/or any other components of the release mechanism 847. Additionally, or alternatively, the controller 804 may be configured to obtain and send data, evaluate data, follow protocols, run algorithms, and send commands. The controller 804 of the release mechanism 847 may include one or more components or modules, including but not limited to a control engine, a data processing module, an organization module, a communication module, a power module, a storage repository (which may include, for example, protocols, algorithms, and stored data), a hardware processor, memory, an application interface, and a security module. The various components of the controller 804 may be centrally located. In addition, or in the alternative, some of the components of the controller 804 may be located remotely from (e.g., in the cloud, at an office building, at the surface 108) one or more of the other components of the controller 804.

Each sensor device 860 of the release mechanism 847 includes one or more sensors that measure one or more parameters (e.g., pressure, flow rate, temperature, an electrical current, magnetic field, radio frequency signals, etc.). Examples of a sensor of a sensor device 860 may include, but are not limited to, a temperature sensor, a flow sensor, a pressure sensor, a voltmeter, an ammeter, a RFID tag reader, a proximity sensor, a magnetic field sensor, and a resistor. A sensor device 860 may be a stand-alone device or integrated with another component (e.g., a wall 356 of the body 355, a barrier 348 of the gravel containment apparatus 345) of an example gravel pack production string component (e.g., gravel pack production string component 330). A parameter measured by a sensor device 860 may be associated with a release agent (e.g., release agent 390).

The timer 807 may track clock time, intervals of time, an amount of time, and/or any other measure of time. The timer 807 may also count the number of occurrences of an event, whether with or without respect to time. The timer 807 may be able to track multiple time measurements and/or count multiple occurrences concurrently. The timer 807 may track time periods based on an instruction obtained from the controller 804, based on an instruction obtained from a user, based on an instruction programmed in the software for the controller 804, based on some other condition (e.g., the occurrence of an event) or from some other component (e.g., an energy storage device 803), or from any combination thereof. In certain example embodiments, the timer 807 may provide a time stamp for each packet of data obtained from another component (e.g., a sensor device 860).

The transceiver 806 may send and/or obtain control and/or communication signals. Specifically, the transceiver 806 may be used to transfer data between the controller 804, a user (including an associated user system), the sensor devices 860, the timer 807, the energy storage devices 803, and the other components of a system (e.g., system 100, system 200). The transceiver 806 may use wired and/or wireless technology. The transceiver 806 may send and/or obtain any of a number of signal types, including but not limited to radio frequency signals, sound and/or other acoustic waves, pressure waves, and sonic signals.

An energy storage device 803 is a component that is configured to provide power to one or more other components (e.g., the controller 804, a sensor device 860) of the release mechanism 847. An energy storage device 803 may be configured to provide power that is of a type (e.g., alternating current, direct current) and level (e.g., 12V, 24V, 120V) that may be used by the other components of the release mechanism 847. An energy storage device 803 may have any of a number of formats (e.g., battery, supercapacitor) using any of a number of technologies.

Figure 9:
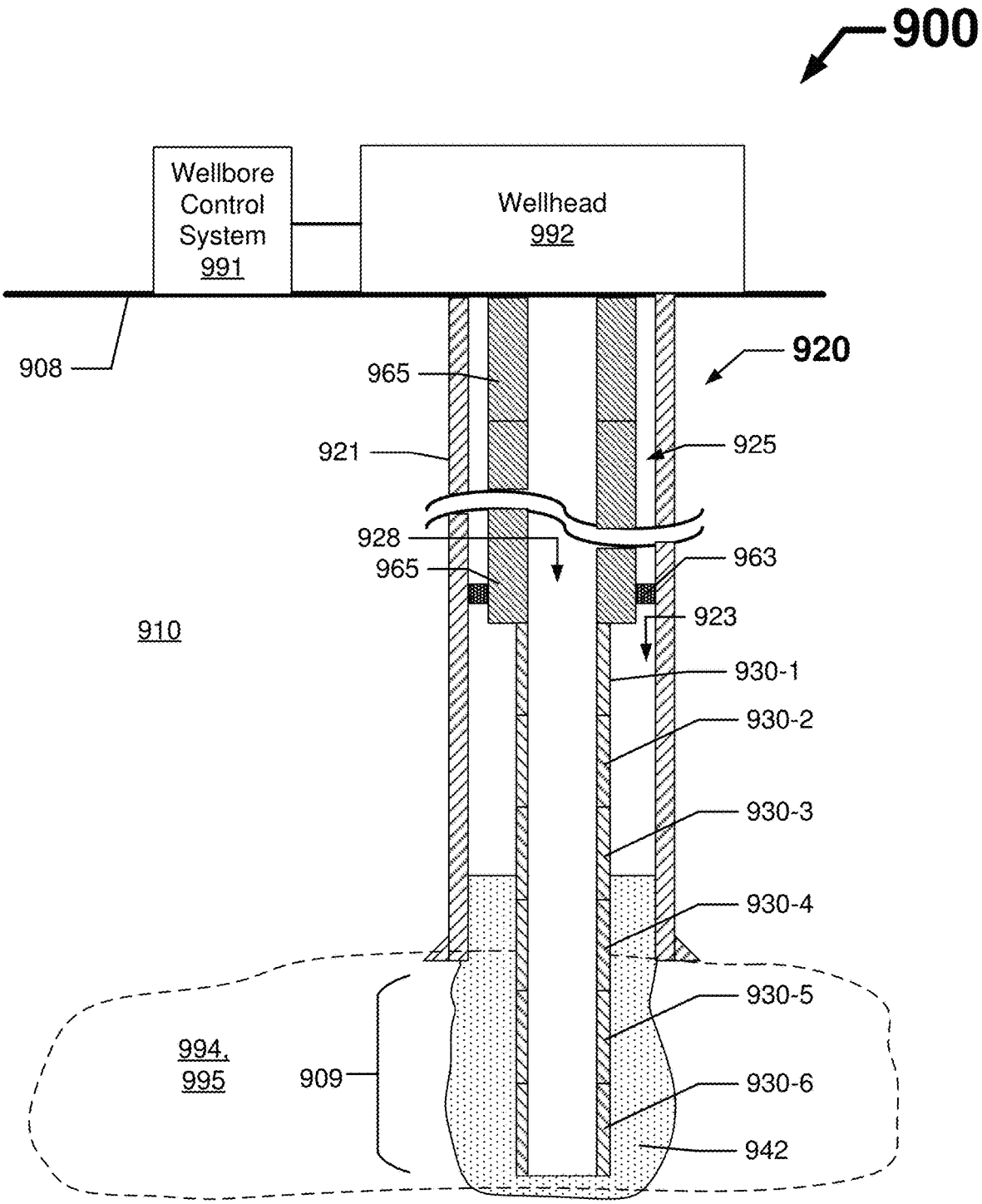
FIG. 9 shows a field system after the first stage of a gravel pack operation has been completed using example gravel pack production string components according to certain example embodiments.
Figure 10:
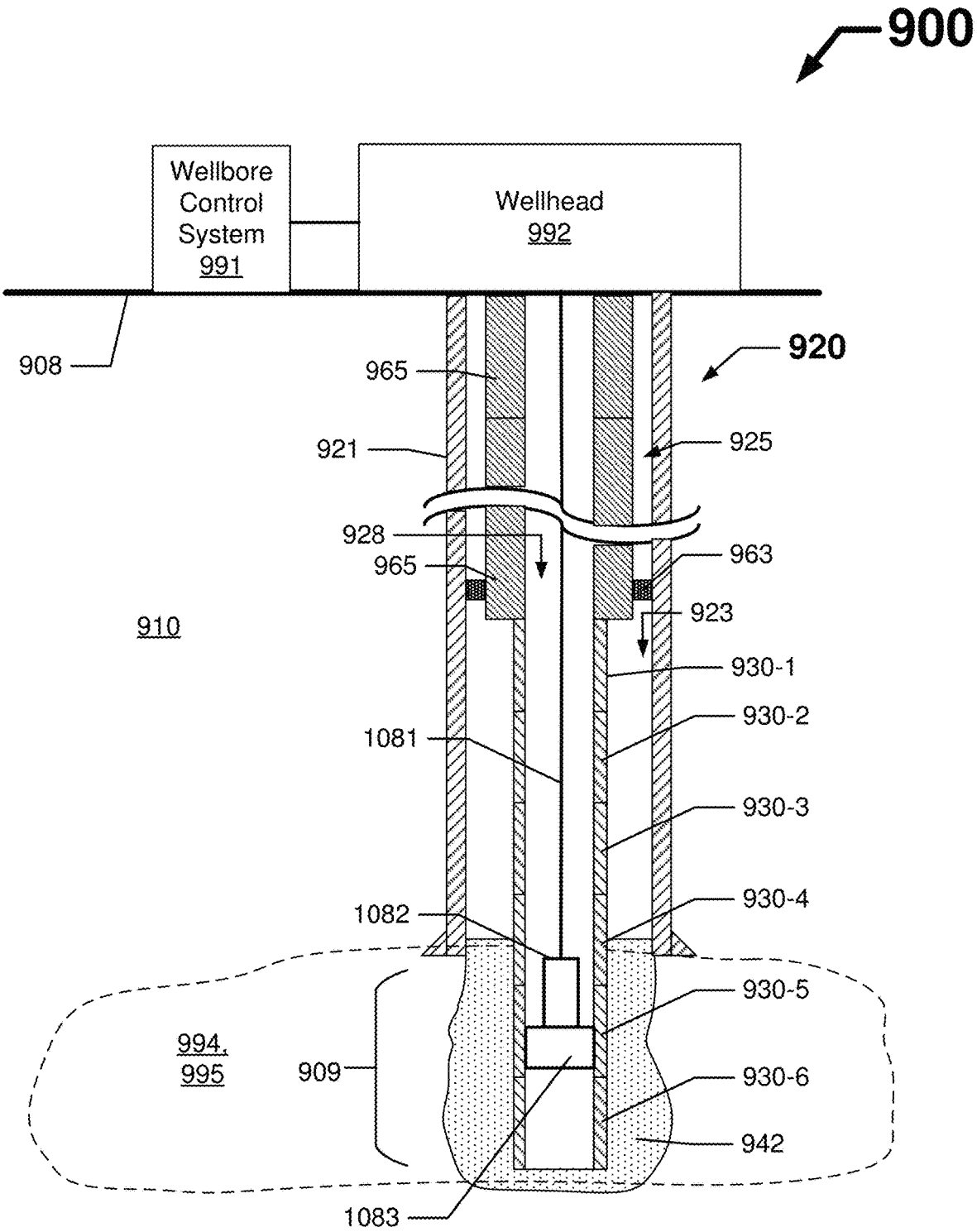
FIG. 10 shows the field system of FIG. 9 after an implementation of the second stage of a gravel pack operation has been completed using example gravel pack production string components according to certain example embodiments.
Figure 11:
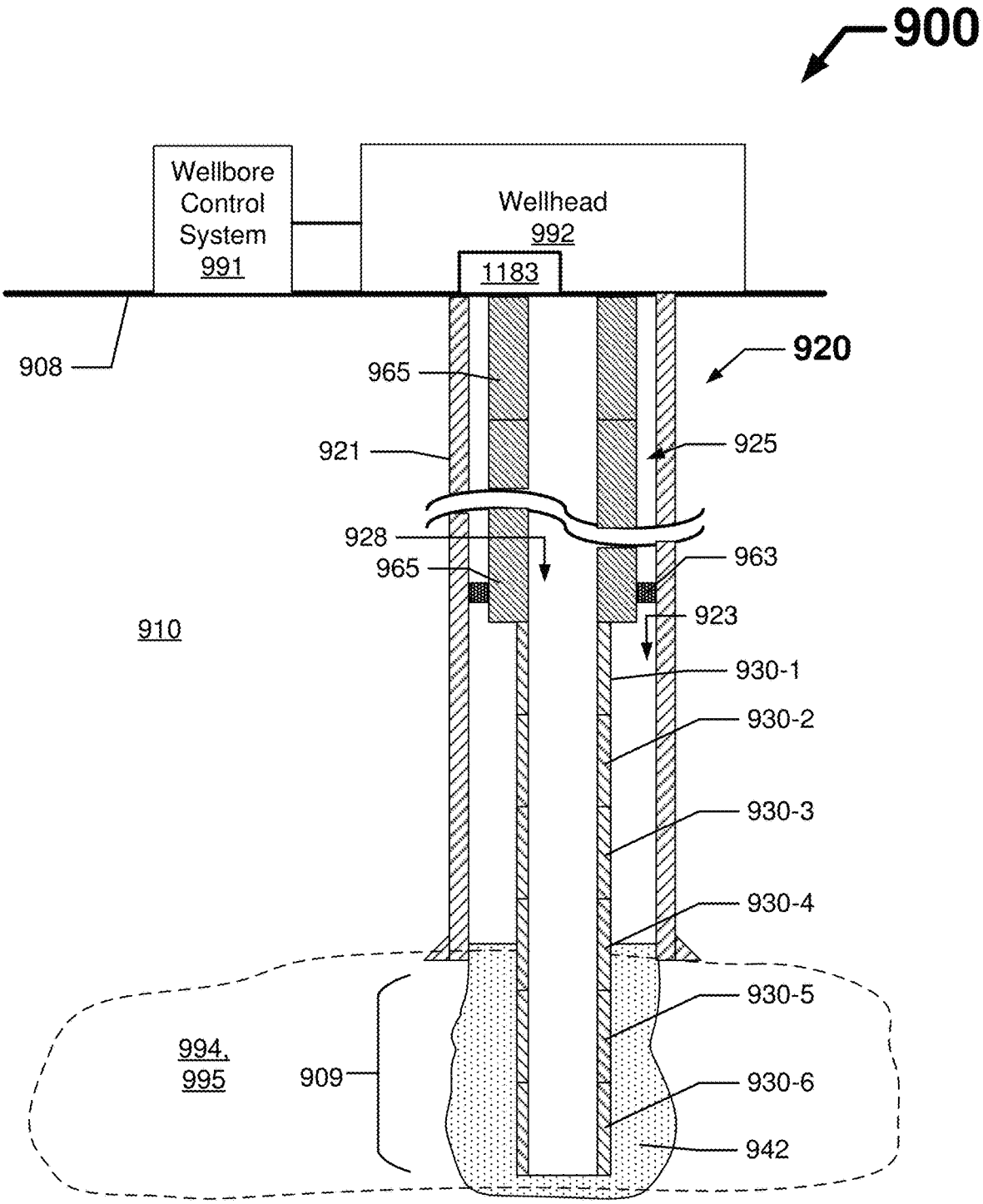
FIG. 11 shows the field system of FIG. 9 after an alternative implementation of the second stage of a gravel pack operation has been completed using example gravel pack production string components according to certain example embodiments.

FIG. 9 shows a field system 900 after the first stage of a gravel pack operation has been completed using example gravel pack production string components according to certain example embodiments. FIG. 10 shows the field system 900 of FIG. 9 after an implementation of the second stage of a gravel pack operation has been completed using example gravel pack production string components according to certain example embodiments. FIG. 11 shows the field system 900 of FIG. 9 after an alternative implementation of the second stage of a gravel pack operation has been completed using example gravel pack production string components according to certain example embodiments.

Referring to the description above with respect to FIG. 1 through 8, the field system 900 of FIGS. 9 through 11 are substantially similar to the field system 100 of FIG. 1. For example, the field system 900 of FIGS. 9 through 11 includes a wellbore 920, a wellbore control system 991, and a wellhead 992. The wellbore 920 is drilled into a subterranean formation 910 having multiple formation layers (e.g., shale, sandstone, limestone, dolomite, granite). In this case, the wellbore 920 is shown to be substantially vertical.

After the wellbore 920 (or segment thereof) is drilled, a casing string 921 (e.g., a series of casing pipes coupled to each other end to end) is inserted into the wellbore 920. In this case, the distal end of the casing string 921 terminates above a production zone 909. In order to make the production zone 909 adjacent to an open hole section of the wellbore 920, after the cement sets, a drilling string is run back into the hole to drill out the bottom of the cement/casing into the open hole section. In some cases, the drill bit of the drilling string may contain an under-reamer that allows the diameter of the open hole section (below the casing string 921) of the wellbore 920 to be larger than the ID of the casing string 921. The additional drilling step after cementing prevents or reduces contaminating the formation with used drilling muds and other issues. In alternative embodiments, the casing string 921 may extend beyond the production zone 909, as in FIG. 2 above. In some cases, cement is injected into the space between the subterranean formation 910 and the outer surface of the casing string 921 to help stabilize the subterranean formation 910 around the wellbore 920. Once this completion process is complete, subsequent field operations (e.g., gravel packing, perforating, fracturing, producing) may occur.

In this case, the production zone 909 within the subterranean formation 910 includes formation material 994, and so a gravel pack operation (or the first stage thereof) has been performed at the time captured in FIG. 9 to prevent most or all of the formation material 994 from being produced, thereby avoiding harmful effects of the formation material 994, as discussed above. The first stage of the gravel pack operation using example embodiments includes having substantially all of the gravel load 942 released from the example gravel pack production string components 930 into the wellbore 920. To prepare for the first stage of the gravel pack operation, a production string 925 is lowered into the wellbore 920 within the casing string 921.

The production string 925 is made up of a number of components that are coupled (e.g., using coupling features such as mating threads) to each other end to end. From the distal end of the production string 925, there are 6 example gravel pack production string components 930, preceded by a number of tubing pipes 965. Gravel pack production string component 930-6, gravel pack production string component 930-5, and gravel pack production string component 930-4 are positioned adjacent to the production zone 909 in the open hole part of the wellbore 920. Gravel pack production string component 930-1, gravel pack production string component 930-2, and gravel pack production string component 930-3 are positioned above the production zone 909 adjacent to the casing string 921 within the wellbore 920.

The production string 925, including the example gravel pack production string components 930, forms a cavity 928 along its length. Also, the outer diameter of the production string 925 is less than the inner diameter of the casing string 921, and an annulus 923 results between the production string 925 and the casing string 921 when the production string 925 is inserted into the wellbore 920. In this case, the annulus 923 within the wellbore 920 above the production zone 909 is isolated by a gravel pack packer 963, which is positioned between a tubing pipe 965 in the production string 925 and the casing string 921 above the example gravel pack production string component 930-1 in the production string 925.

In this case, the configuration of all six gravel pack production string components 930 are substantially the same as the gravel pack production string component 730 of FIG. 7 above. At the time shown in FIG. 9, a release agent (e.g., an acidic liquid, a series of vibrations, a sustained elevated pressure), where the release agent is substantially similar to the release agent 790 of FIG. 7A, has already been deployed into the wellbore 920 and caused the gravel load 942 of each gravel pack production string component 930 to be released into the wellbore 920. As a result, the gravel load 942 is piled to a depth within the casing string 921.

However, the gravel pack operation will not be successful unless there is substantially grain-to-grain contact. At the time shown in FIG. 9, there are too many voids in the gravel load 942 to effectively filter out enough of the formation material 994 during production of the formation fluids 995. In order to make the gravel load 942 more effective, a second stage of the gravel pack operation must be implemented. One way to implement the second stage of the gravel pack operation is shown in FIG. 10, where a downhole tool 1082 is lowered into the cavity 928 using a tether 1081 (e.g., a wireline, a coiled tubing) from the surface 908 using the wellbore control system 991. At the end of the downhole tool 1082 is a vibrating device 1083, which is positioned to make contact with the production string 925 within the wellbore 920. As the vibrating device 1083 vibrates, the vibrations translate through the base (e.g., body 755) of each gravel pack production string component 930 to "fluidize" the gravel load 942, causing the gravel load 942 to settle and greatly reduce, if not eliminate, voids in the gravel load 942 that would allow formation material 994 to pass therethrough. As a result, as shown in FIG. 10, the top of the gravel load 942 is lowered toward the distal end of the casing string 921 at a level that is lower than the depth of the gravel load 942 shown in FIG. 9.

Another way to implement the second stage of the gravel pack operation is shown in FIG. 11, where a vibrating device 1183 is positioned at or near the surface 908 (e.g., at the wellhead 992) to communicate vibrations through the top of the production string 925. As the vibrating device 1183 vibrates, the vibrations translate through the base (e.g., body 755) of each gravel pack production string component 930 to "fluidize" the gravel load 942, causing the gravel load 942 to settle and greatly reduce, if not eliminate, voids in the gravel load 942 that would allow formation material 994 to pass therethrough. As a result, as shown in FIG. 11, the top of the gravel load 942 is lowered toward the distal end of the casing string 921 at a level that is lower than the depth of the gravel load 942 shown in FIG. 9.

One or more additional or alternative steps may be taken to implement the second stage of the gravel pack operation. For example, a fluid (e.g., water) may be pumped down the annulus 923 in order to cause the gravel load 942 to settle within the wellbore 920. In any case, example embodiments avoid pumping a slurry of gravel into the wellbore 920, as is done in the current art to implement a gravel pack operation. In some cases, after the second stage of the gravel pack operation has been completed (i.e., after the gravel load 942 has settled), the top of the gravel load 942 may be in the annulus 923 (in contact with the inner surface of the casing string 921 and the outer surface of the production string 925).

Figure 12:
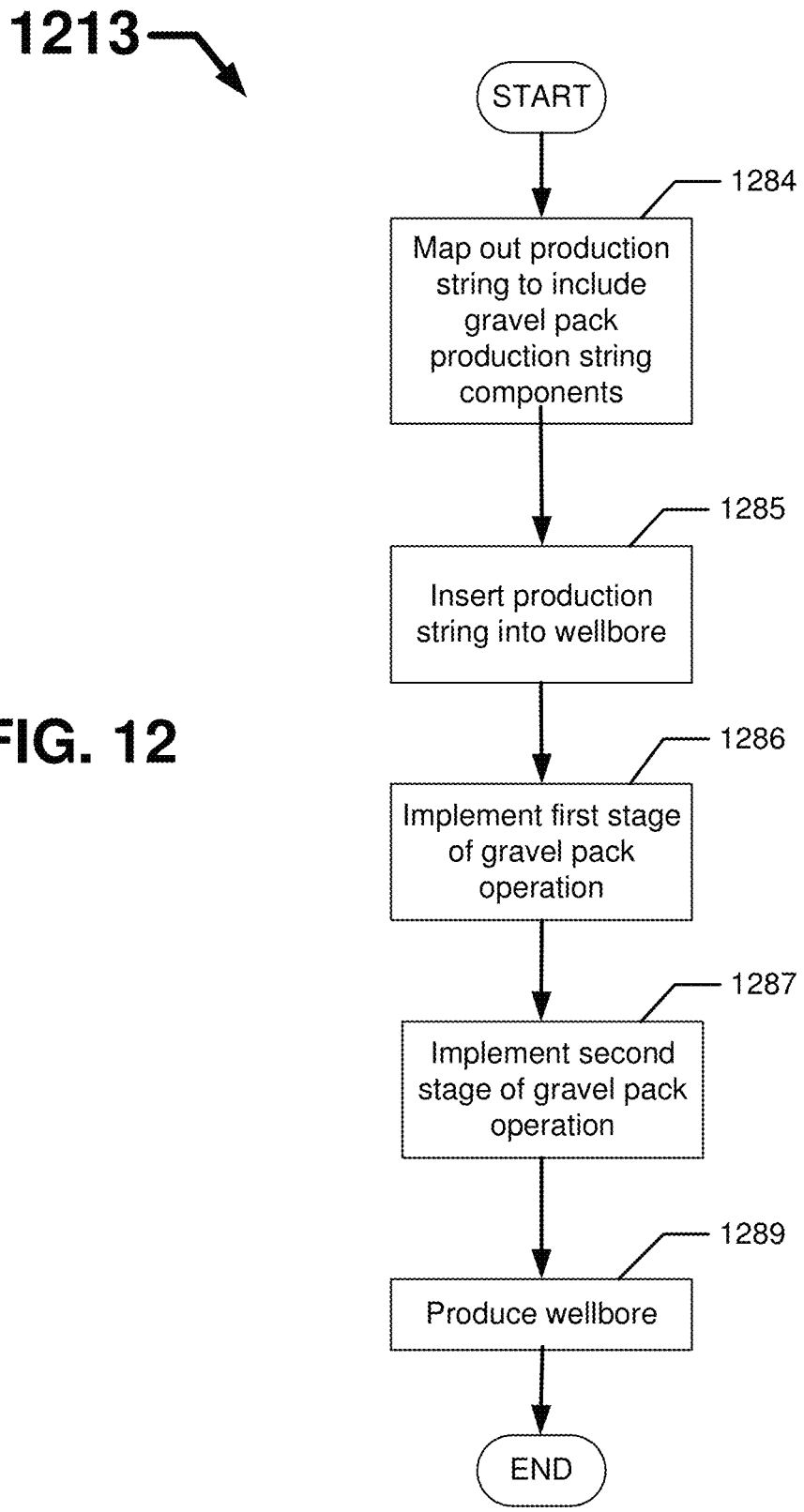
FIG. 12 shows a flowchart of a method for performing a gravel pack operation within a wellbore according to certain example embodiments.

FIG. 12 shows a flowchart of a method for performing a gravel pack operation within a wellbore according to certain example embodiments. While the various steps in this flowchart 1213 are presented sequentially, one of ordinary skill will appreciate that some or all of the steps may be executed in different orders, may be combined or omitted, and some or all of the steps may be executed in parallel. Further, in one or more of the example embodiments, one or more of the steps shown in this example method may be omitted, repeated, and/or performed in a different order.

In addition, a person of ordinary skill in the art will appreciate that additional steps not shown in FIG. 12 may be included in performing this method shown in the flowchart 1213. Accordingly, the specific arrangement of steps should not be construed as limiting the scope. Further, a controller or other type of computing device with a non-transitory computer readable medium can be used to perform or facilitate performance of one or more of the steps for the method shown in FIG. 12 in certain example embodiments. Any of the functions performed or facilitated by a controller can involve the use of one or more protocols, one or more algorithms, measurements from one or more sensor devices, and/or stored data stored in a storage repository. In addition, or in the alternative, any of the functions in the method may be performed by a user (e.g., a company that employs and/or contracts roughnecks and a drilling engineer). In some cases, any of the functions in the method may be or facilitated or directed by a user (e.g., a representative of an oil and gas company, a representative of an oil services company) to be performed by one or more third parties (e.g., a drilling engineer, roughnecks) for the benefit of the user.

The method shown in FIG. 12 is merely an example that can be performed to perform a gravel pack operation within a wellbore. In other words, systems used to perform a gravel pack operation within a wellbore can perform other functions using other methods in addition to and/or aside from those shown in FIG. 12. Referring to the description above with respect to FIGS. 1 through 11, the method shown in the flowchart 1213 of FIG. 12 begins at the START step and proceeds to step 1284, where a production string (e.g., production string 125, production string 225) is mapped out. In certain example embodiments, the production string includes one or more example gravel pack production string components 330. Mapping out the production string may include the number of components (including the example gravel pack production string components 330) and the configuration of each of the components (including the example gravel pack production string components 330). Mapping out the production string may be based on a number of factors, including but not limited to the depth of the wellbore, the location of the production zone (e.g., production zone 109), and the amount of formation material (e.g., formation material 194). Some or all of these factors may be directly measured (e.g., using sensor devices) and/or output by models.

In step 1285, the production string is inserted into the wellbore. In certain example embodiments, most, if not all, of the early components of the production string are example gravel pack production string components 330 of one or more of any of a number of configurations. In step 1286, the first stage of the gravel pack operation is implemented. In certain example embodiments, the first stage of the gravel pack operation includes introducing one or more release agents (e.g., release agent 390) to the example gravel pack production string components 330 so that the gravel load 342 of each example gravel pack production string component 330 is released into the wellbore, such as what is described above with respect to FIGS. 3A through 7C. The first stage of the gravel pack operation may be implemented using a wellbore control system (e.g., wellbore control system 291).

In step 1287, the second stage of the gravel pack operation is implemented. In certain example embodiments, the second stage of the gravel pack operation includes performing one or more actions within the wellbore to reduce or eliminate voids in the gravel load 942, such as what is described above with respect to FIGS. 10 and 11. The second stage of the gravel pack operation may be implemented using a wellbore control system (e.g., wellbore control system 191) and/or a vibrating device (e.g., vibrating device 1083, vibrating device 1183). In certain example embodiments, step 1287 may be performed before or at substantially the same time as step 1286. In step 1289, the wellbore is produced. When step 1289 is complete, the process proceeds to the END step.

Figure 13:
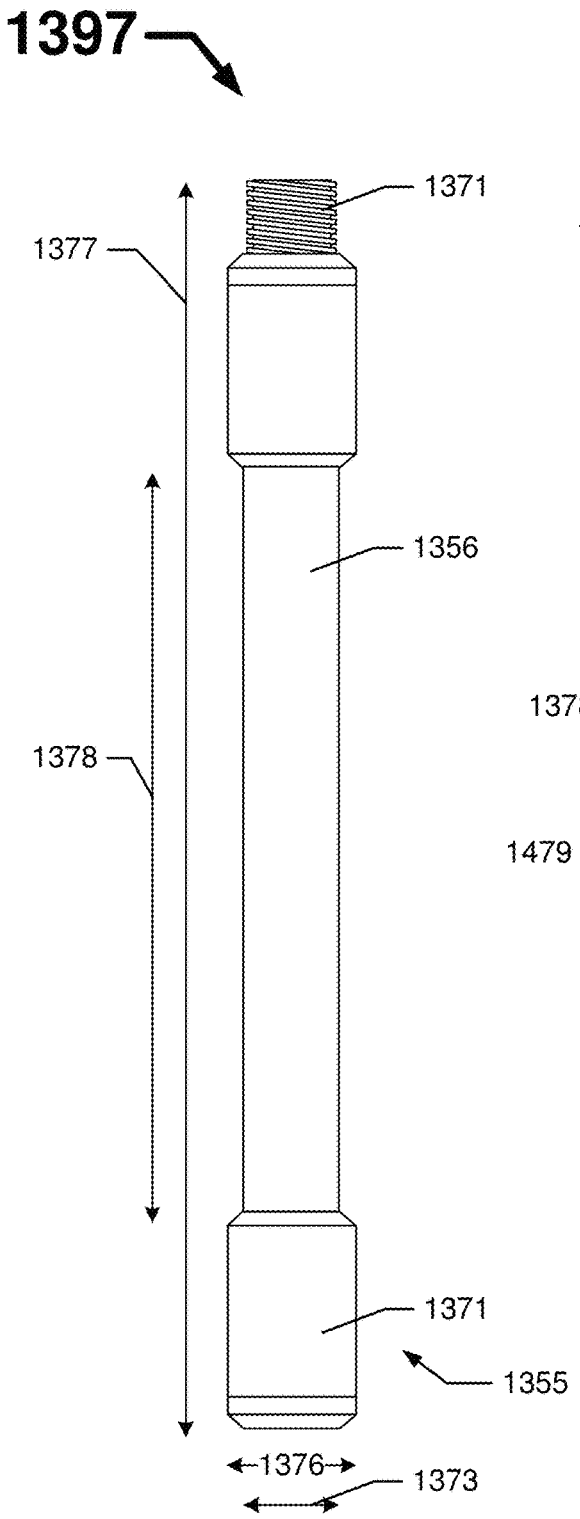
FIG. 13 shows a side view of a drill pipe that may be converted to an example gravel pack production string component according to certain example embodiments.
Figure 14:
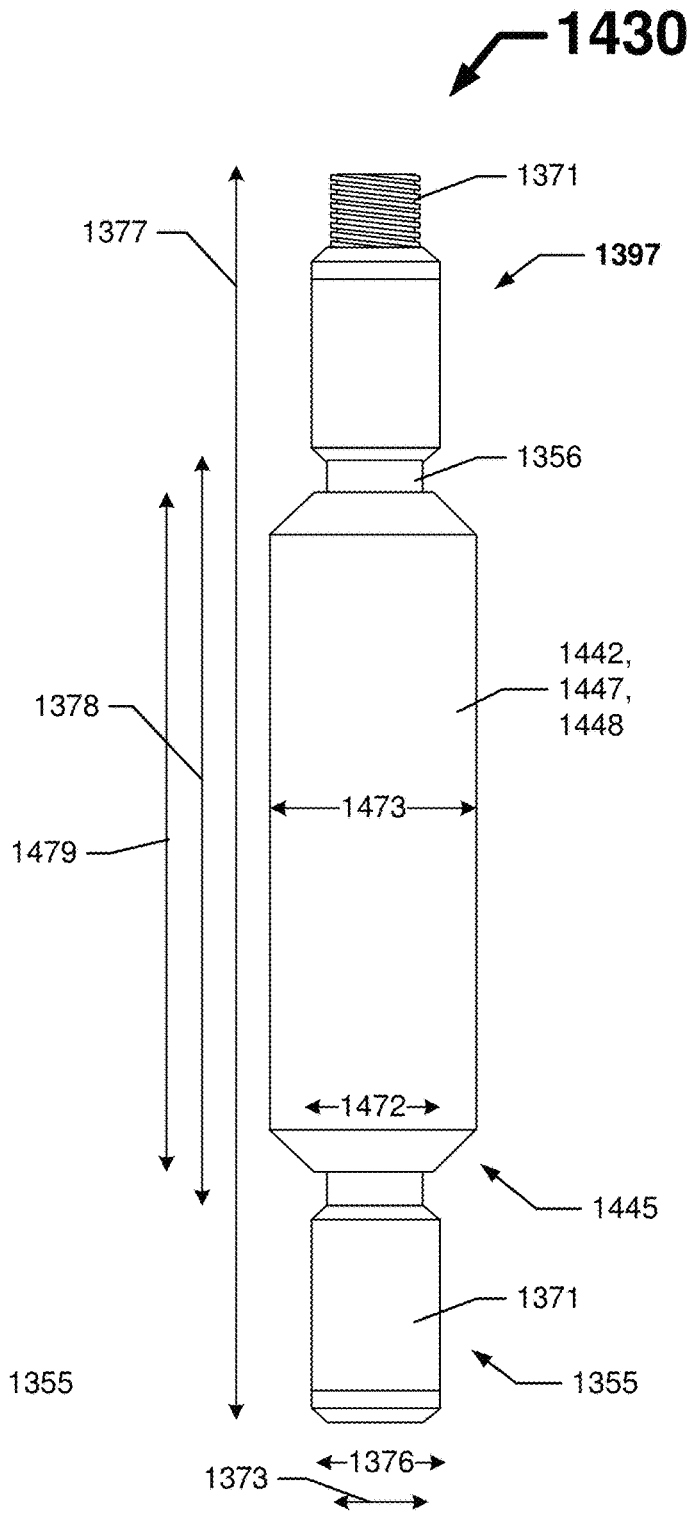
FIG. 14 shows a side view of the drill pipe of FIG. 13 that has been converted to an example gravel pack production string component according to certain example embodiments.

FIG. 13 shows a side view of a drill pipe 1397 that may be converted to an example gravel pack production string component according to certain example embodiments. FIG. 14 shows a side view of the drill pipe 1397 of FIG. 13 that has been converted to an example gravel pack production string component 1430 according to certain example embodiments. Referring to the description above with respect to FIGS. 1 through 12, the drill pipe 1397 of FIG. 13 has a body 1355 that includes a wall 1356 and a coupling feature 1371 (in this case, in the form of mating threads) at each end of the wall 1356. As used herein, the term "drill pipe" may include any type of tubular known in the industry, including but not limited to a tubing pipe, tubing, a drill pipe, and an oil country tubular good (OCTG).

The body 1355 has an overall height 1377 (sometimes called a length) that can vary (e.g., 18 feet, 27 feet, 33 feet). Each end of the body 1355 (which includes a coupling feature 1371 and part of the wall 1356) has a maximum diameter 1376 that is greater than the diameter 1373 of the remainder of the wall 1356. Those of ordinary skill in the art will recognize the bottom coupling feature 1371 and the bottom part of the wall 1356 that has the diameter 1376 in FIG. 13 as a box end, and the top coupling feature 1371 and the top part of the wall 1356 that has the diameter 1376 in FIG. 13 as a pin end. The part of the wall 1356 that has outer diameter 1373 has a height 1378 that is less than the height 1377 of the body 1355. While the orientation of the drill pipe 1397 and the example gravel pack production string component 1430 is shown as having the pin end is at the top (e.g., uphole) and the box end at the bottom (e.g., downhole), the orientation of the drill pipe 1397 and the example gravel pack production string component 1430 may also be reversed so that the pin end is at the bottom (e.g., downhole) and the box end is at the top (e.g., uphole).

As an example, when the drill pipe 1397 has a 5-⅞" outer diameter 1376 (e.g., as used for subsea wellbores), the tool joints (the ends of the body 1355 with the coupling features 1371) take up from 44" to 52" inches from the total drill pipe length (the height 1377), taper from the tool joint outer diameter (7.625") down to the pipe body outer diameter 1373 (5.875"), which takes place over about 6". A short amount of free standard outer diameter pipe body is required on each end of the body 1355 to make connections. For a standard Range 3 joint of drill pipe (~38 feet overall height 1377), that leaves a height 1378 of about 33.5 feet of free pipe body (wall 1356), of which about 28 feet would be available for the gravel containment apparatus 1445.

By adding a gravel containment apparatus 1445, which includes one or more barriers 1448 to contain a gravel load 1442, combined with a release mechanism 1447 to the drill pipe 1397 of FIG. 13, the example gravel pack production sub 1430 of FIG. 14 results. The gravel containment apparatus 1445 is applied to the blank pipe portion (within the height 1378 along the wall 1356 of the body 1355) for integration into a production string as part of a gravel pack operation. The gravel containment apparatus 1445 may be applied over the wall 1356 of the body 1355 approximately as shown in FIG. 14.

In certain example embodiments, the gravel containment apparatus 1445 may be tapered (from a minimum diameter 1472 to a maximum diameter 1473) at each end as shown to prevent or reduce the risk of hanging up on anything as it (along with the rest of the production string) is run into the wellbore. The gravel containment apparatus 1445 also has a height 1479. As discussed above, the gravel containment apparatus 1445 may have any of a number of configurations and/or may be applied to the drill pipe 1397 in any of a number of ways. As some nonlimiting examples, the gravel containment apparatus 1445 may be molded in place, bolted on, and/or strapped on (e.g., clamshell style). Regardless of how the gravel containment apparatus 1445 is applied to the drill pipe 1397, the resulting example gravel pack production sub 1430 provides (or helps to provide) the ability to stage the proper amount of gravel load 1442 in the wellbore.

When the gravel load 1442 is released (by any number of mechanisms, as discussed above) using the release mechanism 1447, the gravel load 1442 may fall by gravity and successfully gravel pack the wellbore without needing to pump gravel in a conventional manner. This facilitates the ability to perform an entire completion (e.g., open hole gravel pack) in one trip of the production string after the wellbore drilling operation is complete. Since gravel pack operations in the current art require at least 2 trips into the wellbore with different equipment, considerable drilling rig time and expenses may be saved using example embodiments, and the use of example embodiments also facilitates earlier production of the wellbore.

The example gravel pack production sub 1430 of FIG. 14 shows that the outside diameter 1473 of the gravel containment apparatus 1445 is larger than the maximum diameter 1376 of the drill pipe 1397. In alternative embodiments, the outside diameter 1473 of the gravel containment apparatus 1445 may be substantially the same size as, or smaller than, the maximum diameter 1376 of the drill pipe 1397. A larger outside diameter 1473 and height 1479 allows the gravel containment apparatus 1445 to hold more gravel load 1442, but these design considerations must be balanced against factors that include, but are not limited to, the size of the wellbore, the curvature of the wellbore, and the height 1377 and/or maximum diameter 1376 of the drill pipe 1397. An objective in designing the example gravel pack production sub 1430 may be to take advantage of the minimum ID expected to be encountered in the wellbore and maximize the size of the gravel containment apparatus 1445 accordingly (with clearance as needed).

Figure 15:
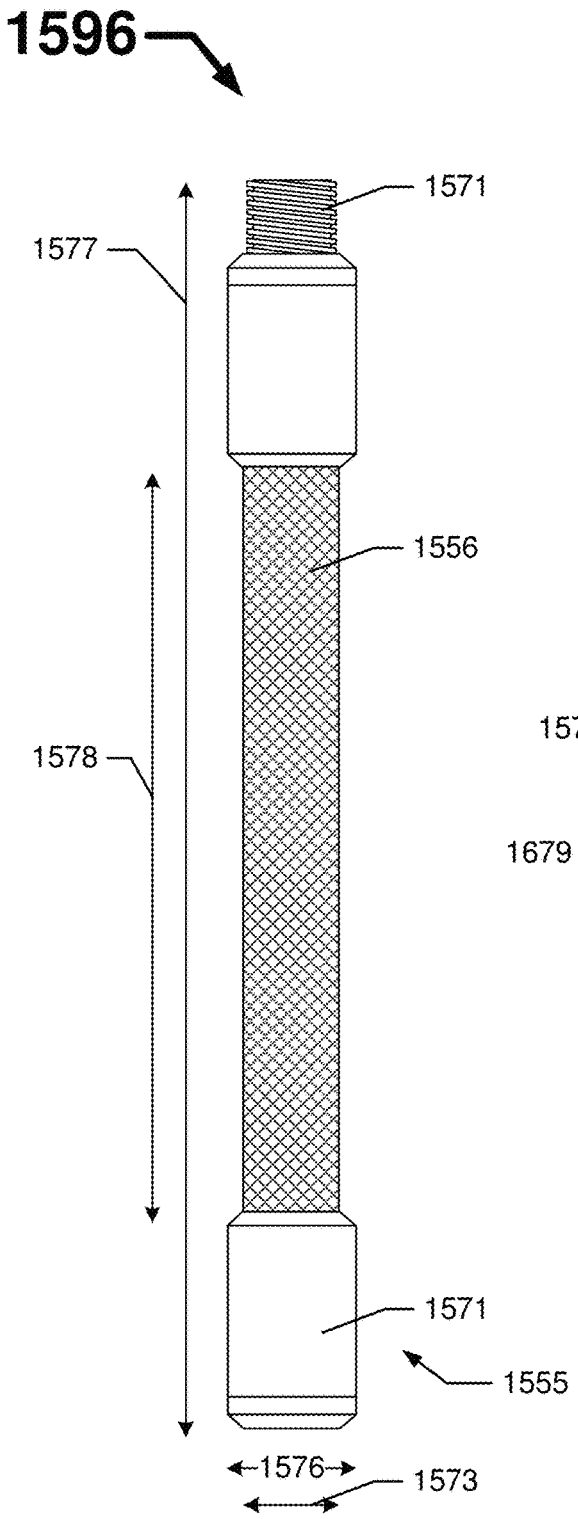
FIG. 15 shows a side view of a production screen sub that may be converted to an example gravel pack production string component according to certain example embodiments.
Figure 16:
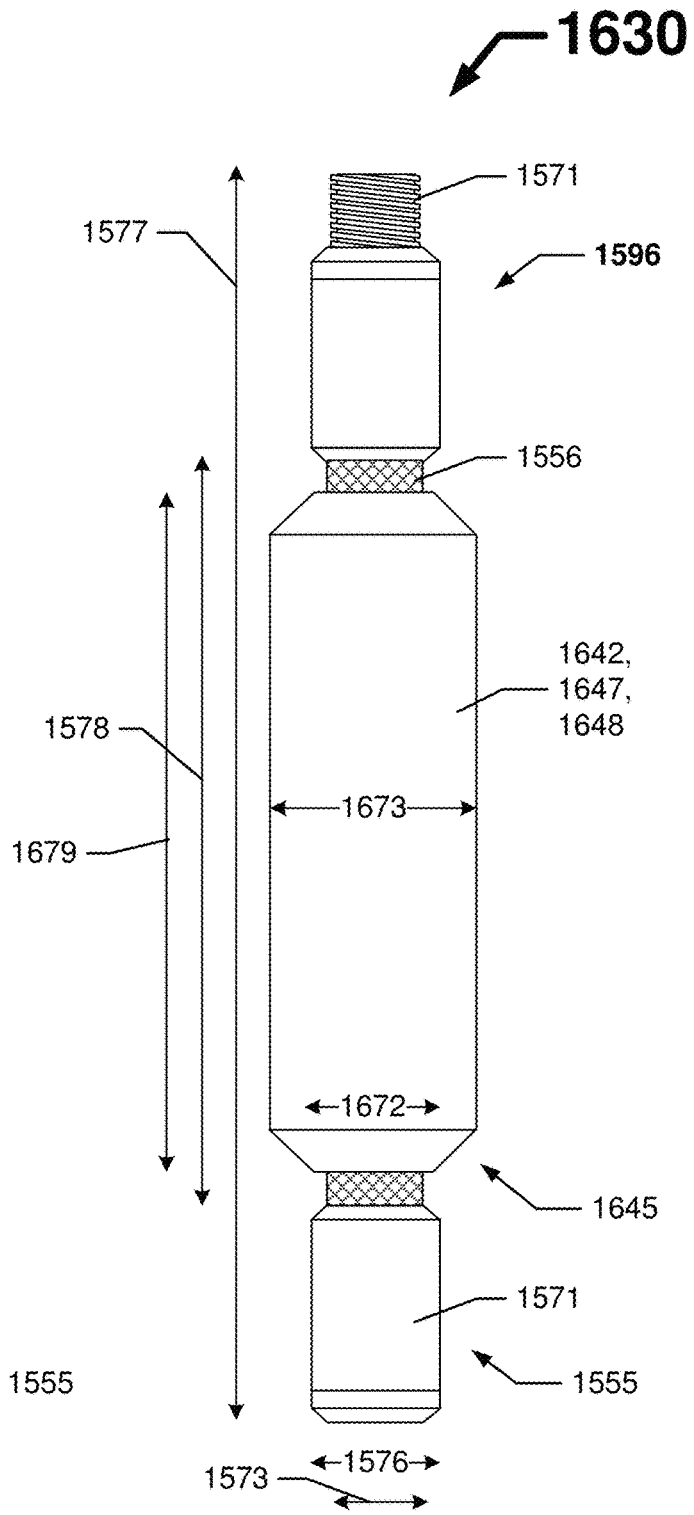
FIG. 16 shows a side view of the production screen sub of FIG. 15 that has been converted to an example gravel pack production string component according to certain example embodiments.

FIG. 15 shows a side view of a production screen sub 1596 that may be converted to an example gravel pack production string component according to certain example embodiments. FIG. 16 shows a side view of the production screen sub 1596 of FIG. 15 that has been converted to an example gravel pack production string component 1630 according to certain example embodiments. Referring to the description above with respect to FIGS. 1 through 14, the production screen sub 1596 of FIG. 15 has a body 1555 that includes a wall 1556 and a coupling feature 1571 (in this case, in the form of mating threads) at each end of the wall 1556.

The body 1555 has an overall height 1577 (sometimes called a length) that can vary (e.g., 18 feet, 27 feet, 33 feet). Each end of the body 1555 (which includes a coupling feature 1571 and part of the wall 1556) has a maximum diameter 1576 that is greater than the diameter 1573 of the remainder of the wall 1556. In some cases, the wall 1556 in the form of a screen may have an outer diameter that is slightly larger than the outer diameter 1573 of other parts of the wall 1556 (e.g., that do not have or include a screen) and that is less than the maximum diameter 1576. Those of ordinary skill in the art will recognize the bottom coupling feature 1571 and the bottom part of the wall 1556 that has the diameter 1576 in FIG. 15 as a box end, and the top coupling feature 1571 and the top part of the wall 1556 that has the diameter 1576 in FIG. 15 as a pin end. The part of the wall 1556 that has outer diameter 1573 has a height 1578 that is less than the height 1577 of the body 1555. While the orientation of the production screen sub 1596 and the example gravel pack production string component 1630 is shown as having the pin end is at the top (e.g., uphole) and the box end at the bottom (e.g., downhole), the orientation of the production screen sub 1596 and the example gravel pack production string component 1630 may also be reversed so that the pin end is at the bottom (e.g., downhole) and the box end is at the top (e.g., uphole).

As an example, when the production screen sub 1596 has a 5-⅞" outer diameter 1576 (e.g., as used for subsea wellbores), the tool joints (the ends of the body 1555 with the coupling features 1571) may take up from 44" to 52" inches from the total drill pipe length (the height 1577), taper from the tool joint outer diameter (7.625") down to the pipe body outer diameter 1573 (5.875"), which takes place over about 6". A short amount of free standard outer diameter pipe body is required on each end of the body 1555 to make connections. For a standard Range 3 joint of a production screen sub (~38 feet overall height 1577), that leaves a height 1578 of about 33.5 feet of free pipe body (wall 1556), of which about 28 feet would be available for the gravel containment apparatus 1645.

By adding a gravel containment apparatus 1645, which includes one or more barriers 1648 to contain a gravel load 1642, combined with a release mechanism 1647 to the production screen sub 1596 of FIG. 15, the example gravel pack production sub 1630 of FIG. 16 results. The gravel containment apparatus 1645 is applied to the blank pipe portion (within the height 1578 along the wall 1556 of the body 1555) for integration into a production string as part of a gravel pack operation. The gravel containment apparatus 1645 may be applied over the wall 1556 of the body 1555 approximately as shown in FIG. 16.

In certain example embodiments, the gravel containment apparatus 1645 may be tapered (from a minimum diameter 1672 to a maximum diameter 1673) at each end as shown to prevent or reduce the risk of hanging up on anything as it (along with the rest of the production string) is run into the wellbore. The gravel containment apparatus 1645 has a height 1679. As discussed above, the gravel containment apparatus 1645 may have any of a number of configurations and/or may be applied to the production screen sub 1596 in any of a number of ways. As some nonlimiting examples, the gravel containment apparatus 1645 may be molded in place, bolted on, and/or strapped on (e.g., clamshell style). Regardless of how the gravel containment apparatus 1645 is applied to the production screen sub 1596, the resulting example gravel pack production sub 1630 provides (or helps to provide) the ability to stage the proper amount of gravel load 1642 in the wellbore.

When the gravel load 1642 is released (by any number of mechanisms, as discussed above) using the release mechanism 1647, the gravel load 1642 may fall by gravity and successfully gravel pack the wellbore without needing to pump gravel in a conventional manner. This facilitates the ability to perform an entire completion (e.g., open hole gravel pack) in one trip of the production string after the wellbore drilling operation is complete. Since gravel pack operations in the current art typically require at least 2 trips into the wellbore with different equipment, considerable drilling rig time and expenses may be saved using example embodiments, and the use of example embodiments also facilitates earlier production of the wellbore.

The example gravel pack production sub 1630 of FIG. 16 shows that the outside diameter 1673 of the gravel containment apparatus 1645 is larger than the maximum diameter 1576 of the production screen sub 1596. In alternative embodiments, the outside diameter 1673 of the gravel containment apparatus 1645 may be substantially the same size as, or smaller than, the maximum diameter 1576 of the production screen sub 1596. A larger outside diameter 1673 and height 1679 allows the gravel containment apparatus 1645 to hold more gravel load 1642, but these design considerations must be balanced against factors that include, but are not limited to, the size of the wellbore, the curvature of the wellbore, and the height 1577 and/or maximum diameter 1576 of the production screen sub 1596. An objective in designing the example gravel pack production sub 1630 may be to take advantage of the minimum ID expected to be encountered in the wellbore and maximize the size of the gravel containment apparatus 1645 accordingly (with clearance as needed).

Figure 17:
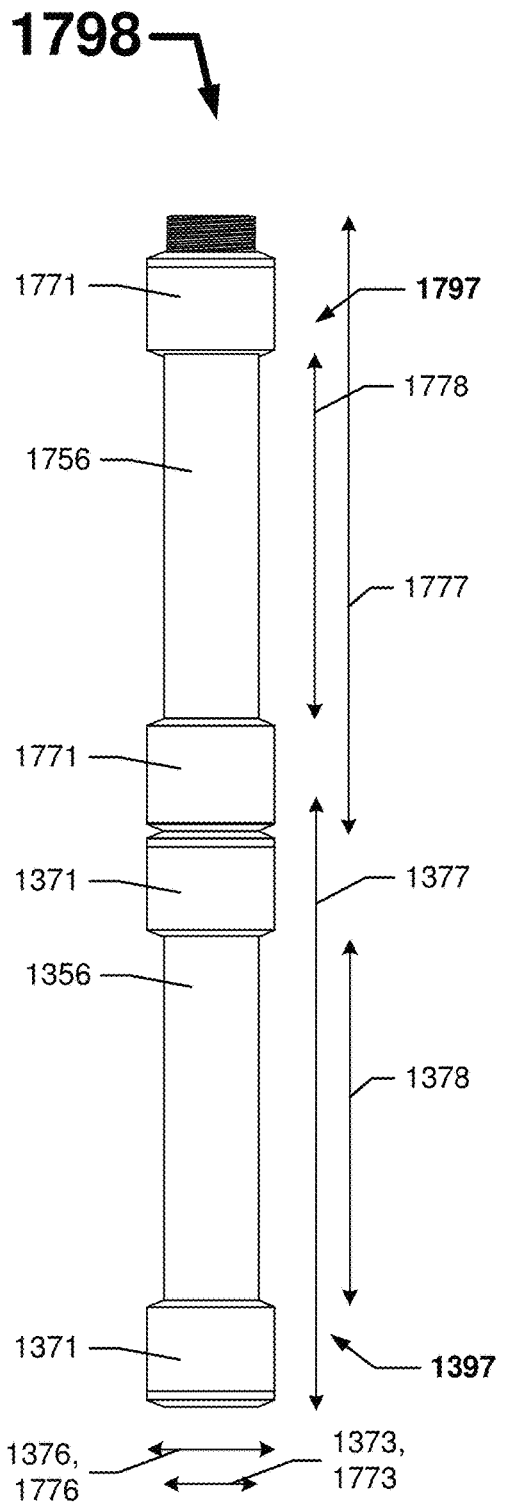
FIG. 17 shows a side view of multiple drill pipes, including the drill pipe of FIG. 13, that are coupled together to create a stand that may be converted to an example gravel pack production string component according to certain example embodiments.
Figure 18:
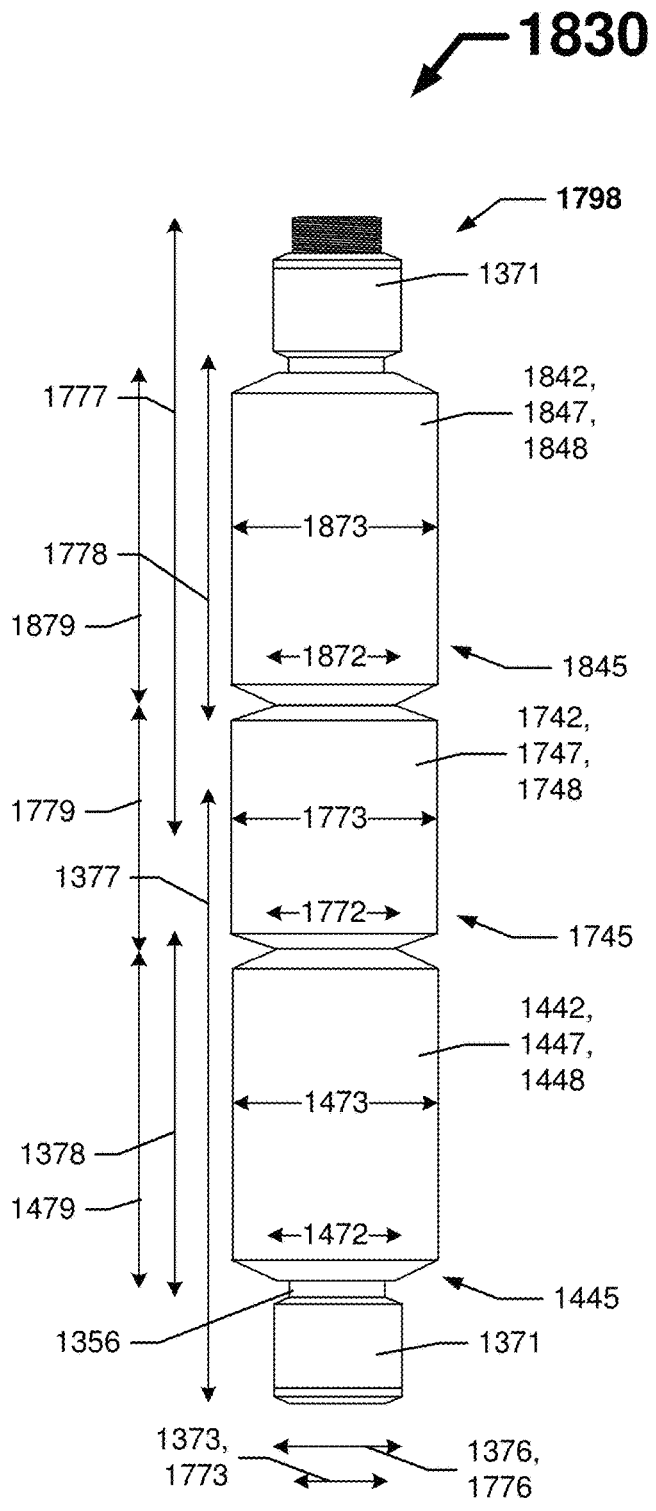
FIG. 18 shows a side view of the stand of FIG. 17 that has been converted to an example gravel pack production string component according to certain example embodiments.

FIG. 17 shows a side view of multiple drill pipes, including the drill pipe 1397 of FIG. 13, that are coupled together to create a stand 1798 that may be converted to an example gravel pack production string component according to certain example embodiments. FIG. 18 shows a side view of the stand 1798 of FIG. 17 that has been converted to an example gravel pack production string component 1830 according to certain example embodiments. Referring to the description above with respect to FIGS. 1 through 16, the stand 1798 of FIG. 17 includes the drill pipe 1397 of FIG. 13 coupled to another drill pipe 1797. While the orientation of the stand 1798 and the example gravel pack production string component 1830 is shown as having the pin end is at the top (e.g., uphole) and the box end at the bottom (e.g., downhole), the orientation of the stand 1798 and the example gravel pack production string component 1830 may also be reversed so that the pin end is at the bottom (e.g., downhole) and the box end is at the top (e.g., uphole).

As discussed above, the drill pipe 1397 has a body 1355 that includes a wall 1356 and a coupling feature 1371 (in this case, in the form of mating threads) at each end of the wall 1356. The body 1355 of the drill pipe 1397 has an overall height 1377 (sometimes called a length) that can vary (e.g., 18 feet, 27 feet, 33 feet). Each end of the body 1355 (which includes a coupling feature 1371 and part of the wall 1356) has a maximum diameter 1376 that is greater than the diameter 1373 of the remainder of the wall 1356. The part of the wall 1356 that has outer diameter 1373 has a height 1378 that is less than the height 1377 of the body 1355.

Similarly, the drill pipe 1797 of the stand 1798 has a body 1755 that includes a wall 1756 and a coupling feature 1771 (in this case, in the form of mating threads) at each end of the wall 1756. The body 1755 of the drill pipe 1797 has an overall height 1777 (sometimes called a length) that can vary (e.g., 18 feet, 27 feet, 33 feet). Each end of the body 1755 (which includes a coupling feature 1771 and part of the wall 1756) has a maximum diameter 1776 that is greater than the diameter 1773 of the remainder of the wall 1756.

The part of the wall 1756 that has outer diameter 1773 has a height 1778 that is less than the height 1777 of the body 1755. In this case, the outer diameter 1773, the maximum diameter 1776, the overall height 1777, and the height 1778 of the drill pipe 1797 are substantially the same as the outer diameter 1373, the maximum diameter 1376, the overall height 1377, and the height 1378 of the drill pipe 1397.

To create the example gravel pack production sub 1830 of FIG. 18, three gravel containment apparatuses are applied to the stand 1798. Specifically, gravel containment apparatus 1445, which includes one or more barriers 1448 to contain a gravel load 1442, combined with a release mechanism 1447, is applied to the wall 1356 of the drill pipe 1397, as discussed above with respect to FIG. 14. In addition, gravel containment apparatus 1845, which includes one or more barriers 1848 to contain a gravel load 1842, combined with a release mechanism 1847, is applied to the wall 1756 of the drill pipe 1797 in a manner similar to the way the gravel containment apparatus 1445 is applied to the drill pipe 1397. Further, gravel containment apparatus 1745, which includes one or more barriers 1748 to contain a gravel load 1742, combined with a release mechanism 1747, is simultaneously applied to 1) the lower part of the wall 1756 and the lower coupling feature 1771 of the drill pipe 1797, and 2) the upper part of the wall 1356 and the upper coupling feature 1371 of the drill pipe 1397.

In alternative embodiments, the example gravel pack production sub 1830 of FIG. 18 may include a single gravel containment apparatus that is longer than, shorter than, or substantially the same as the combined length of the gravel containment apparatus 1445, the gravel containment apparatus 1745, and the gravel containment apparatus 1845. In other alternative embodiments, the example gravel pack production sub 1830 of FIG. 18 may include two gravel containment apparatuses that are collectively longer than, shorter than, or substantially the same as the combined length of the gravel containment apparatus 1445, the gravel containment apparatus 1745, and the gravel containment apparatus 1845. In yet other alternative embodiments, the example gravel pack production sub 1830 of FIG. 18 may include more than three gravel containment apparatuses that are collectively longer than, shorter than, or substantially the same as the combined length of the gravel containment apparatus 1445, the gravel containment apparatus 1745, and the gravel containment apparatus 1845.

In this case, each of the gravel containment apparatuses of the gravel pack production sub 1830 of FIG. 18 have a height and are tapered at each end as shown to prevent or reduce the risk of hanging up on anything as it (along with the rest of the production string) is run into the wellbore. Specifically, gravel containment apparatus 1445 has a height 1479 and is tapered (from a minimum diameter 1472 to a maximum diameter 1473) at each end. Gravel containment apparatus 1745 has a height 1779 and is tapered (from a minimum diameter 1772 to a maximum diameter 1773) at each end. Gravel containment apparatus 1845 has a height 1879 and is tapered (from a minimum diameter 1872 to a maximum diameter 1873) at each end. The height, the maximum diameter, and/or the minimum diameter of one gravel containment apparatus may be the same as, or different than, the height, the maximum diameter, and/or the minimum diameter of one or more of the other gravel containment apparatuses of the example gravel pack production sub 1830 of FIG. 18.

As discussed above, each gravel containment apparatus may have any of a number of configurations and/or may be applied to the drill pipe 1397 and/or the drill pipe 1797 in any of a number of ways. As some nonlimiting examples, each gravel containment apparatus may be molded in place, bolted on, and/or strapped on (e.g., clamshell style). Regardless of how the gravel containment apparatuses are applied to the drill pipe 1397 and/or the drill pipe 1797, the resulting example gravel pack production sub 1830 provides (or helps to provide) the ability to stage the proper amount of gravel load (the combination of the gravel 1442, the gravel load 1742, and the gravel load 1842) in the wellbore.

When the collective gravel load of the example gravel pack production sub 1830 is released (by any number of mechanisms, as discussed above) using the release mechanism 1447, the release mechanism 1747, and/or the release mechanism 1847, the collective gravel load may fall by gravity and successfully gravel pack the wellbore without needing to pump gravel in a conventional manner. This facilitates the ability to perform an entire completion (e.g., open hole gravel pack) in one trip of the production string after the wellbore drilling operation is complete. Since gravel pack operations in the current art typically require at least 2 trips into the wellbore with different equipment, considerable drilling rig time and expenses may be saved using example embodiments, and the use of example embodiments also facilitates earlier production of the wellbore.

The example gravel pack production sub 1830 of FIG. 18 shows that the outside diameter 1473 of the gravel containment apparatus 1445, the outside diameter 1773 of the gravel containment apparatus 1745, and the outside diameter 1873 of the gravel containment apparatus 1845 are larger than the maximum diameter 1376 of the drill pipe 1397 and the maximum diameter 1776 of the drill pipe 1797. In alternative embodiments, the outside diameter of one or more of the gravel containment apparatuses may be substantially the same size as, or smaller than, the maximum diameter of one or both of the drill pipes. A larger outside diameter and height allows one or more of the gravel containment apparatuses to hold more gravel load, but these design considerations must be balanced against factors that include, but are not limited to, the size of the wellbore, the curvature of the wellbore, and the height and/or maximum diameter of one or both of the drill pipes. An objective in designing the example gravel pack production sub 1830 may be to take advantage of the minimum ID expected to be encountered in the wellbore and maximize the size of the gravel containment apparatuses accordingly (with clearance as needed).

Figure 19:
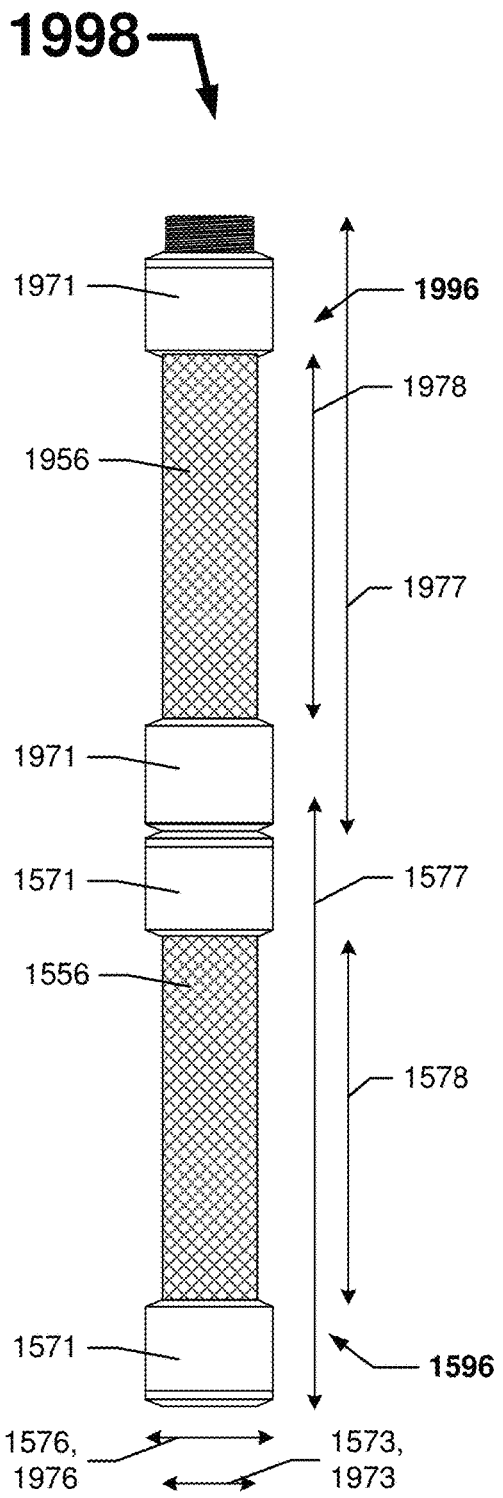
FIG. 19 shows a side view of multiple production screen subs, including the production screen sub of FIG. 15, that are coupled together to create a stand that may be converted to an example gravel pack production string component according to certain example embodiments.
Figure 20:
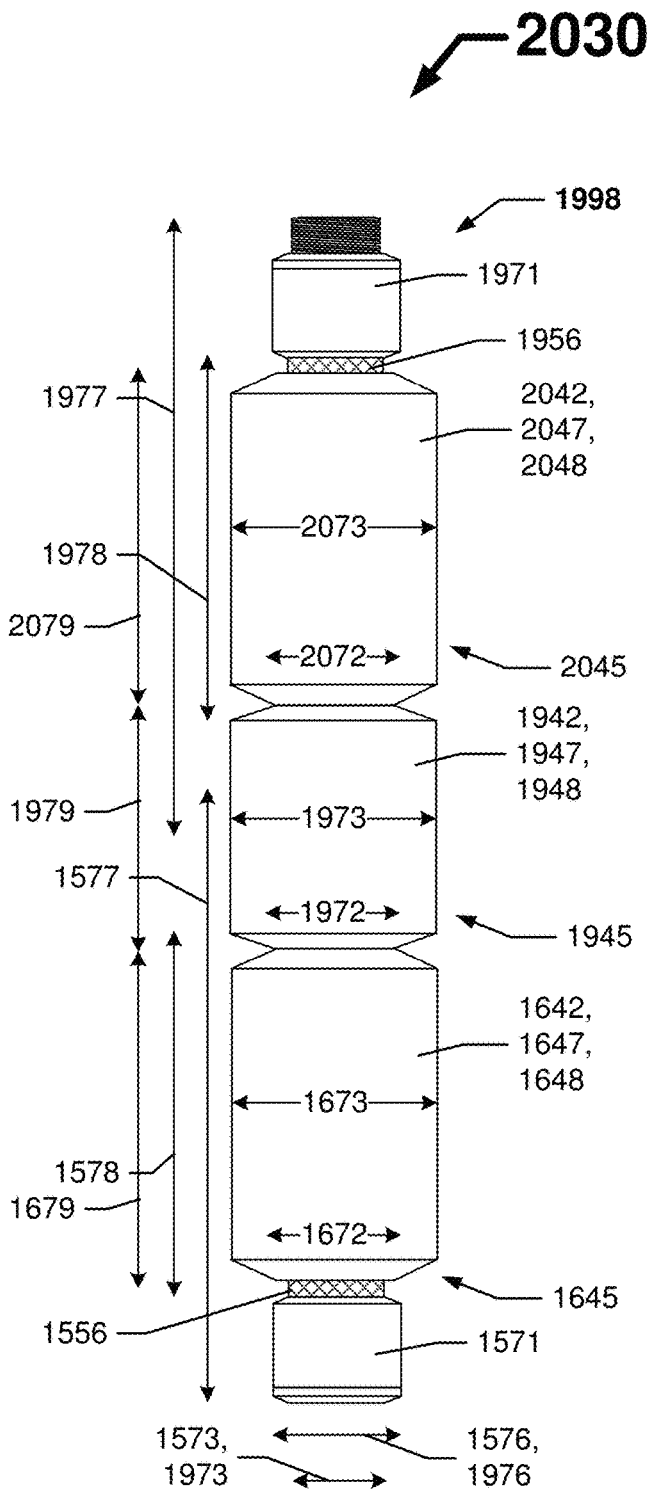
FIG. 20 shows a side view of the stand of FIG. 19 that has been converted to an example gravel pack production string component according to certain example embodiments.

FIG. 19 shows a side view of multiple production screen subs, including the production screen sub 1596 of FIG. 15, that are coupled together to create a stand 1998 that may be converted to an example gravel pack production string component according to certain example embodiments. FIG. 20 shows a side view of the stand 1998 of FIG. 19 that has been converted to an example gravel pack production string component 2030 according to certain example embodiments. Referring to the description above with respect to FIGS. 1 through 18, the stand 1998 of FIG. 19 includes the production screen sub 1596 of FIG. 15 coupled to another production screen sub 1996. While the orientation of the stand 1998 and the example gravel pack production string component 2030 is shown as having the pin end is at the top (e.g., uphole) and the box end at the bottom (e.g., downhole), the orientation of the stand 1998 and the example gravel pack production string component 2030 may also be reversed so that the pin end is at the bottom (e.g., downhole) and the box end is at the top (e.g., uphole).

As discussed above, the production screen sub 1596 has a body 1555 that includes a wall 1556 and a coupling feature 1571 (in this case, in the form of mating threads) at each end of the wall 1556. The body 1555 of the production screen sub 1596 has an overall height 1577 (sometimes called a length) that can vary (e.g., 18 feet, 27 feet, 33 feet). Each end of the body 1555 (which includes a coupling feature 1571 and part of the wall 1556) has a maximum diameter 1576 that is greater than the diameter 1573 of the remainder of the wall 1556. The part of the wall 1556 that has outer diameter 1573 has a height 1578 that is less than the height 1577 of the body 1555.

Similarly, the production screen sub 1996 of the stand 1998 has a body 1955 that includes a wall 1956 and a coupling feature 1971 (in this case, in the form of mating threads) at each end of the wall 1956. The body 1955 of the production screen sub 1996 has an overall height 1977 (sometimes called a length) that can vary (e.g., 18 feet, 27 feet, 33 feet). Each end of the body 1955 (which includes a coupling feature 1971 and part of the wall 1956) has a maximum diameter 1976 that is greater than the diameter 1973 of the remainder of the wall 1956. The part of the wall 1956 that has outer diameter 1973 has a height 1978 that is less than the height 1977 of the body 1955. In this case, the outer diameter 1973, the maximum diameter 1976, the overall height 1977, and the height 1978 of the production screen sub 1996 are substantially the same as the outer diameter 1573, the maximum diameter 1576, the overall height 1577, and the height 1578 of the production screen sub 1596. In some cases, the wall 1956 in the form of a screen may have an outer diameter that is slightly larger than the outer diameter 1973 of other parts of the wall 1956 (e.g., that do not have or include a screen) and that is less than the maximum diameter 1976.

To create the example gravel pack production sub 2030 of FIG. 20, three gravel containment apparatuses are applied to the stand 1998. Specifically, gravel containment apparatus 1645, which includes one or more barriers 1648 to contain a gravel load 1642, combined with a release mechanism 1647, is applied to the wall 1556 of the production screen sub 1596, as discussed above with respect to FIG. 16. In addition, gravel containment apparatus 2045, which includes one or more barriers 2048 to contain a gravel load 2042, combined with a release mechanism 2047, is applied to the wall 1956 of the production screen sub 1996 in a manner similar to the way the gravel containment apparatus 1645 is applied to the production screen sub 1596. Further, gravel containment apparatus 1945, which includes one or more barriers 1948 to contain a gravel load 1942, combined with a release mechanism 1947, is simultaneously applied to 1) the lower part of the wall 1956 and the lower coupling feature 1971 of the production screen sub 1996, and 2) the upper part of the wall 1556 and the upper coupling feature 1571 of the production screen sub 1596.

In alternative embodiments, the example gravel pack production sub 2030 of FIG. 20 may include a single gravel containment apparatus that is longer than, shorter than, or substantially the same as the combined length of the gravel containment apparatus 1645, the gravel containment apparatus 1945, and the gravel containment apparatus 2045. In other alternative embodiments, the example gravel pack production sub 2030 of FIG. 20 may include two gravel containment apparatuses that are collectively longer than, shorter than, or substantially the same as the combined length of the gravel containment apparatus 1645, the gravel containment apparatus 1945, and the gravel containment apparatus 2045. In yet other alternative embodiments, the example gravel pack production sub 2030 of FIG. 20 may include more than three gravel containment apparatuses that are collectively longer than, shorter than, or substantially the same as the combined length of the gravel containment apparatus 1645, the gravel containment apparatus 1945, and the gravel containment apparatus 2045.

In this case, each of the gravel containment apparatuses of the gravel pack production sub 2030 of FIG. 20 have a height and are tapered at each end as shown to prevent or reduce the risk of hanging up on anything as it (along with the rest of the production string) is run into the wellbore. Specifically, gravel containment apparatus 1645 has a height 1679 and is tapered (from a minimum diameter 1672 to a maximum diameter 1673) at each end. Gravel containment apparatus 1945 has a height 1979 and is tapered (from a minimum diameter 1972 to a maximum diameter 1973) at each end. Gravel containment apparatus 2045 has a height 2079 and is tapered (from a minimum diameter 2072 to a maximum diameter 2073) at each end. The height, the maximum diameter, and/or the minimum diameter of one gravel containment apparatus may be the same as, or different than, the height, the maximum diameter, and/or the minimum diameter of one or more of the other gravel containment apparatuses of the example gravel pack production sub 2030 of FIG. 20.

As discussed above, each gravel containment apparatus may have any of a number of configurations and/or may be applied to the production screen sub 1596 and/or the production screen sub 1996 in any of a number of ways. As some nonlimiting examples, each gravel containment apparatus may be molded in place, bolted on, and/or strapped on (e.g., clamshell style). Regardless of how the gravel containment apparatuses are applied to the production screen sub 1596 and/or the production screen sub 1996, the resulting example gravel pack production sub 2030 provides (or helps to provide) the ability to stage the proper amount of gravel load (the combination of the gravel 1642, the gravel load 1942, and the gravel load 2042) in the wellbore.

When the collective gravel load of the example gravel pack production sub 2030 is released (by any number of mechanisms, as discussed above) using the release mechanism 1647, the release mechanism 1947, and/or the release mechanism 2047, the collective gravel load may fall by gravity and successfully gravel pack the wellbore without needing to pump gravel in a conventional manner. This facilitates the ability to perform an entire completion (e.g., open hole gravel pack) in one trip of the production string after the wellbore drilling operation is complete. Since gravel pack operations in the current art typically require at least 2 trips into the wellbore with different equipment, considerable drilling rig time and expenses may be saved using example embodiments, and the use of example embodiments also facilitates earlier production of the wellbore.

The example gravel pack production sub 2030 of FIG. 20 shows that the outside diameter 1573 of the gravel containment apparatus 1645, the outside diameter 1973 of the gravel containment apparatus 1945, and the outside diameter 2073 of the gravel containment apparatus 2045 are larger than the maximum diameter 1576 of the production screen sub 1596 and the maximum diameter 1976 of the production screen sub 1996. In alternative embodiments, the outside diameter of one or more of the gravel containment apparatuses may be substantially the same size as, or smaller than, the maximum diameter of one or both of the production screen subs. A larger outside diameter and height allows one or more of the gravel containment apparatuses to hold more gravel load, but these design considerations must be balanced against factors that include, but are not limited to, the size of the wellbore, the curvature of the wellbore, and the height and/or maximum diameter of one or both of the production screen subs. An objective in designing the example gravel pack production sub 2030 may be to take advantage of the minimum ID expected to be encountered in the wellbore and maximize the size of the gravel containment apparatuses accordingly (with clearance as needed).

The use of the terms "about", "approximately", and similar terms applies to all numeric values, whether or not explicitly indicated. These terms generally refer to a range of numbers that one of ordinary skill in the art would consider as a reasonable amount of deviation to the recited numeric values (i.e., having the equivalent function or result). For example, this term may be construed as including a deviation of ±10 percent of the given numeric value provided such a deviation does not alter the end function or result of the value. Therefore, a value of about 1% may be construed to be a range from 0.9% to 1.1%. Furthermore, a range may be construed to include the start and the end of the range. For example, a range of 10% to 20% (i.e., range of 10%-20%) includes 10% and also includes 20%, and includes percentages in between 10% and 20%, unless explicitly stated otherwise herein. Similarly, a range of between 10% and 20% (i.e., range between 10%-20%) includes 10% and also includes 20%, and includes percentages in between 10% and 20%, unless explicitly stated otherwise herein.

It is understood that when combinations, subsets, groups, etc. of elements are disclosed (e.g., combinations of components in a composition, or combinations of steps in a method), that while specific reference of each of the various individual and collective combinations and permutations of these elements may not be explicitly disclosed, each is specifically contemplated and described herein. By way of example, if an item is described herein as including a component of type A, a component of type B, a component of type C, or any combination thereof, it is understood that this phrase describes all of the various individual and collective combinations and permutations of these components.

For example, in some embodiments, the item described by this phrase could include only a component of type A. In some embodiments, the item described by this phrase could include only a component of type B. In some embodiments, the item described by this phrase could include only a component of type C. In some embodiments, the item described by this phrase could include a component of type A and a component of type B. In some embodiments, the item described by this phrase could include a component of type A and a component of type C. In some embodiments, the item described by this phrase could include a component of type B and a component of type C. In some embodiments, the item described by this phrase could include a component of type A, a component of type B, and a component of type C.

In some embodiments, the item described by this phrase could include two or more components of type A (e.g., A1 and A2). In some embodiments, the item described by this phrase could include two or more components of type B (e.g., B1 and B2). In some embodiments, the item described by this phrase could include two or more components of type C (e.g., C1 and C2). In some embodiments, the item described by this phrase could include two or more of a first component (e.g., two or more components of type A (A1 and A2)), optionally one or more of a second component (e.g., optionally one or more components of type B), and optionally one or more of a third component (e.g., optionally one or more components of type C).

In some embodiments, the item described by this phrase could include two or more of a first component (e.g., two or more components of type B (B1 and B2)), optionally one or more of a second component (e.g., optionally one or more components of type A), and optionally one or more of a third component (e.g., optionally one or more components of type C). In some embodiments, the item described by this phrase could include two or more of a first component (e.g., two or more components of type C (C1 and C2)), optionally one or more of a second component (e.g., optionally one or more components of type A), and optionally one or more of a third component (e.g., optionally one or more components of type B).

A user may be any person that is involved with gravel pack operations and/or example gravel pack production string components that are used in such gravel pack operations. In addition, or in the alternative, a user may be a person or entity involved in a production operation with respect to one or more subterranean wellbores. Examples of a user may include, but are not limited to, an engineer, an electrician, an instrumentation and controls technician, a roughneck, a mechanic, an operator, an employee, a consultant, a contractor, a representative of an oil and gas company, and a manufacturer's representative.

Example embodiments of gravel pack production string components (including portions thereof) can be made of one or more of a number of suitable materials to allow the associated system or subsystem to meet certain standards and/or regulations while also maintaining durability in light of the one or more conditions under which the example embodiments of gravel pack production string components and/or other associated components of the example embodiments of gravel pack production string components can be exposed. Examples of such materials can include, but are not limited to, aluminum, stainless steel, carbon steel, fiberglass, glass, plastic, thermoplastic, ceramic, and rubber.

When used in certain systems (e.g., for certain subterranean field operations), example embodiments (including portions thereof) can be designed to comply with certain standards and/or requirements. Examples of entities that set such standards and/or requirements can include, but are not limited to, the Society of Petroleum Engineers, the American Petroleum Institute (API), the International Standards Organization (ISO), the International Association of Classification Societies (IACS), and the Occupational Safety and Health Administration (OSHA).

Example embodiments of gravel pack production string components, or portions or components thereof, described herein can be made from a single piece (e.g., as from a mold, injection mold, casting, die cast, forging, extrusion process, or 3D printing). In addition, or in the alternative, example embodiments of gravel pack production string components (including portions or components thereof) can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, snap fittings, and slotted fittings. One or more pieces that are mechanically coupled to each other can be coupled to each other in one or more of a number of ways, including but not limited to fixedly, hingedly, removably, slidably, and threadably.

Components and/or features described herein can include elements that are described as coupling, fastening, securing, abutting against, in communication with, or other similar terms. Such terms are merely meant to distinguish various elements and/or features within a component or device and are not meant to limit the capability or function of that particular element and/or feature. For example, a feature described as a "coupling feature" can couple, secure, fasten, abut against, and/or perform other functions aside from merely coupling.

A coupling feature (including a complementary coupling feature) as described herein can allow one or more components and/or portions of an example of a gravel pack production string component to become coupled, directly or indirectly, to one or more other components of the embodiment of the gravel pack production string component and/or to some other component of a system or subsystem. A coupling feature can include, but is not limited to, a clamp, a portion of a hinge, an aperture, a recessed area, a protrusion, a hole, a slot, a tab, a detent, and mating threads. One portion of an example embodiment of a gravel pack production string component can be coupled to another component of the example gravel pack production string component and/or to some other component of a system or subsystem by the direct use of one or more coupling features.

In addition, or in the alternative, a portion of an example embodiment of a gravel pack production string component can be coupled to another component of the example gravel pack production string component and/or to another component of a system or subsystem using one or more independent devices that interact with one or more coupling features disposed on a component of the example embodiment of a gravel pack production string component. Examples of such devices can include, but are not limited to, a pin, a hinge, a fastening device (e.g., a bolt, a screw, a rivet), epoxy, glue, adhesive, and a spring. One coupling feature described herein can be the same as, or different than, one or more other coupling features described herein. A complementary coupling feature as described herein can be a coupling feature that mechanically couples, directly or indirectly, with another coupling feature.

If a component of a figure is described but not expressly shown or labeled in that figure, the label used for a corresponding component in another figure may be inferred to that component. Conversely, if a component in a figure is labeled but is not described, the description for such component may be substantially the same as the description for the corresponding component in another figure. The numbering scheme for the various components in the figures herein is such that each component is a three-digit number or a four-digit number, and corresponding components in other figures have the identical last two digits. For any figure shown and described herein, one or more of the components may be omitted, added, repeated, and/or substituted. Accordingly, embodiments shown in a particular figure should not be considered limited to the specific arrangements of components shown in such figure.

Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

Example embodiments of gravel pack production string components will be described more fully hereinafter with reference to the accompanying drawings, in which example embodiments of gravel pack production string components are shown. Example embodiments of gravel pack production string components may, however, be embodied in many different forms and should not be construed as limited to the example embodiments set forth herein. Rather, these example embodiments are provided so that this disclosure will be thorough and complete, and will fully convey the scope of example embodiments of gravel pack production string components to those of ordinary skill in the art. Like, but not necessarily the same, elements (also sometimes called components) in the various figures are denoted by like reference numerals for consistency.

Terms such as "first", "second", "primary," "secondary," "above", "below", "inner", "outer", "distal", "proximal", "end", "top", "bottom", "upper", "lower", "side", "width,", "height", "depth", "length", "left", "right", "front", "rear", and "within", when present, are used merely to distinguish one component (or part of a component or state of a component or orientation of a component) from another. This list of terms is not exclusive. Such terms are not meant to denote a preference or a particular orientation, and they are not meant to limit example embodiments of gravel pack production string components. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Example embodiments may be used to provide systems and methods for gravel pack production string components used in gravel pack operations. Specifically, example embodiments allow for a single trip, open-hole gravel pack (OHGP) completion. Example embodiments eliminate the need for generating a slurry of gravel and pumping the slurry down the annulus of a wellbore. Example embodiments use a gravel pack production string component to reduce or eliminate formation material in a subterranean formation from being produced with production fluids. Example embodiments simplify gravel pack operations. Example embodiments also provide flexibility as to how gravel pack production string components are implemented. Example embodiments may provide a number of other benefits. Such other benefits may include, but are not limited to, more reliable field operations, ease of installation and use, reduced downtime, reduced need for expensive rig equipment, increased flexibility, configurability, and compliance with applicable industry standards and regulations.

Although embodiments described herein are made with reference to example embodiments, it should be appreciated by those skilled in the art that various modifications are well within the scope of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A gravel pack production string component of a production string used for a gravel pack operation, the gravel pack production string component comprising:

a body comprising a wall that forms a cavity;

a gravel load disposed around an outer surface of the wall of the body;

a gravel containment apparatus that is configured to secure the gravel load against the outer surface of the wall of the body as the gravel pack production string component is inserted into a wellbore, wherein the gravel containment apparatus has a maximum diameter that is configured to be less than an inner diameter of a casing string within the wellbore to provide for an annulus therebetween; and a release mechanism that is configured to release the gravel load from the gravel containment apparatus after the gravel pack production string component is positioned within the wellbore for the gravel pack operation and when the release mechanism interacts with a release agent.

2. The gravel pack production string component of claim 1, wherein the wall of the body comprises a screen or other form of mesh that is configured to provide fluidic communication between the cavity and an annulus in the wellbore.

3. The gravel pack production string component of claim 1, wherein the wall of the body comprises a solid non-permeable material that is configured to provide a fluidic barrier between the cavity and an annulus in the wellbore.

4. The gravel pack production string component of claim 1, wherein the gravel load comprises loose gravel.

5. The gravel pack production string component of claim 4, wherein the gravel containment apparatus comprises a second wall.

6. The gravel pack production string component of claim 5, wherein the release mechanism comprises a chemical composition that is configured to dissolve when the release mechanism interacts with the release agent.

7. The gravel pack production string component of claim 5, wherein the release mechanism comprises a characteristic in the second wall that is configured to break the second wall when a pressure exceeds a threshold value, wherein the release agent comprises the pressure.

8. The gravel pack production string component of claim 1, wherein the gravel containment apparatus comprises a solidified version of a liquid that is mixed with the gravel load before solidifying.

9. The gravel pack production string component of claim 8, wherein the release mechanism comprises a chemical component of the gravel containment apparatus that is configured to liquify when the release mechanism interacts with the release agent comprising a second liquid.

10. The gravel pack production string component of claim 8, wherein the release mechanism comprises a characteristic in the second wall that is configured to break the second wall when a vibration exceeds a threshold value, wherein the release agent comprises a vibrating apparatus that sends the vibration through the gravel containment mechanism.

11. The gravel pack production string component of claim 1, wherein the gravel containment apparatus comprises a sleeve having an inner diameter that is larger than an outer diameter of the wall of the body.

12. The gravel pack production string component of claim 11, wherein the sleeve comprises multiple pieces that are coupled to each other.

13. The gravel pack production string component of claim 12, wherein the release mechanism comprises a coupling feature that couples the multiple pieces to each other, and wherein the release mechanism is configured to become decoupled upon an occurrence of a condition.

14. The gravel pack production string component of claim 13, wherein the condition comprises a lapse of time.

15. The gravel pack production string component of claim 13, wherein the condition comprises receipt of a communication signal comprising an instruction to begin the gravel pack operation.

16. The gravel pack production string component of claim 13, wherein the condition comprises a sonic wave to which the coupling feature is exposed.

17. A system for implementing a gravel pack operation, the system comprising:

a wellbore control system that is configured to control a release agent within a wellbore; and a production string disposed in the wellbore, wherein the production string comprises a gravel pack production string component, wherein the gravel pack production string component comprises:

a body comprising a wall that forms a cavity;

a gravel load disposed around an outer surface of the wall of the body;

a gravel containment apparatus that is configured to secure the gravel load against the outer surface of the wall of the body as the gravel pack production string component is inserted into a wellbore, wherein the gravel containment apparatus has a maximum diameter that is configured to be less than an inner diameter of a casing string within the wellbore to provide for an annulus therebetween; and a release mechanism that is configured to release the gravel load from the gravel containment apparatus after the gravel pack production string component is positioned within the wellbore for the gravel pack operation and when the release mechanism interacts with the release agent.

18. The system of claim 17, further comprising:

a wellbore control system configured to reduce voids in the gravel load within the wellbore after the gravel load is released from the gravel containment apparatus.

19. A method for implementing a gravel pack operation, the method comprising:

directing a production string to be inserted into a wellbore, wherein the production string comprises a gravel pack production string component, and wherein the gravel pack production string component comprises:

a body comprising a wall that forms a cavity;

a gravel load disposed around an outer surface of the wall of the body;

a gravel containment apparatus that is configured to secure the gravel load against the outer surface of the wall of the body as the gravel pack production string component is inserted into a wellbore, wherein the gravel containment apparatus has a maximum diameter that is configured to be less than an inner diameter of a casing string within the wellbore to provide for an annulus therebetween; and a release mechanism that is configured to release the gravel load from the gravel containment apparatus after the gravel pack production string component is positioned within the wellbore for the gravel pack operation and when the release mechanism interacts with a release agent; and directing a first stage of the gravel pack operation to be implemented, wherein the first stage comprises exposing the release agent to the release mechanism of the gravel pack production string component.

20. The method of claim 19, further comprising:

directing a second stage of the gravel pack operation to be implemented using a wellbore control system, wherein the wellbore control system is configured to reduce voids in the gravel load within the wellbore after the first stage of the operation is complete.

* * * * *